US005778867A

United States Patent [19]

Osanai

[11] Patent Number: 5,778,867

[45] Date of Patent: Jul. 14, 1998

[54] EVAPORATIVE CONTROL SYSTEM FOR INTERNAL COMBUSTION ENGINE AND METHOD THEREFOR

[75] Inventor: Akinori Osanai, Susono, Japan

[73] Assignee: Toyota Jidosha Kabushiki Kaisha, Aichi, Japan

[21] Appl. No.: 785,456

[22] Filed: Jan. 17, 1997

[30] Foreign Application Priority Data

Jan. 19, 1996 [JP] Japan ..... 8-007603

[51] Int. Cl.[6] ..... F02M 25/08

[52] U.S. Cl. ..... 123/698; 123/520

[58] Field of Search ..... 123/698, 520, 123/674, 675

[56] References Cited

U.S. PATENT DOCUMENTS

| | | | |
|---|---|---|---|
| 5,469,833 | 11/1995 | Hara et al. | 123/698 |
| 5,507,269 | 4/1996 | Morikawa | 123/684 |
| 5,572,980 | 11/1996 | Nakagawa et al. | 123/681 |
| 5,609,142 | 3/1997 | Osanai | 123/520 |
| 5,623,914 | 4/1997 | Kawamoto et al. | 123/689 |

FOREIGN PATENT DOCUMENTS

| | | |
|---|---|---|
| 4-1658 | 1/1992 | Japan . |
| 5-241129 | 8/1994 | Japan . |
| 6-229330 | 8/1994 | Japan . |

OTHER PUBLICATIONS

Copending U.S. Patent Application Serial No. 548,887, filed Oct. 26, 1995.

*Primary Examiner*—Tony M. Argenbright
*Assistant Examiner*—Heu T. Vo
*Attorney, Agent, or Firm*—Kenyon & Kenyon

[57] ABSTRACT

An object of the present invention is to improve the performance of purifying an exhaust gas by suppressing the variation of the air-fuel ratio of an engine occurring when the rotation cycle of the engine is substantially synchronous with the drive cycle of a purging control valve, and to prevent misfiring caused by a lean air-fuel mixture. An evaporative control system includes a purging control valve, located in a purge passage for communicating a canister with an intake passage of an engine, for controlling an amount of purged gas; an air-fuel ratio sensor; a fuel injection control device A, an engine speed detecting device, a duty cycle limiting device that, when a synchronism engine speed domain judging device for judging whether or not the engine speed of the engine falls within a synchronism domain in which synchronism with the drive cycle of the purging control valve is substantially attained, judges that the engine speed of the engine falls within the synchronism domain, and limits a duty cycle to a value within a set range according to the engine speed of the engine; a purge ratio calculating device for calculating a purge ratio according to the duty cycle limited to any value; and a purging control valve open/close control device for opening or closing the purging control valve at the duty cycle to provide the purge ratio calculated by the purge ratio calculating device.

6 Claims, 18 Drawing Sheets

EVAPORATIVE CONTROL SYSTEM FOR INTERNAL COMBUSTION ENGINE AND METHOD THEREFOR

BACKGROUND OF THE INVENTION

1. Field of the Invention

The present invention relates to an evaporative control system and a method for internal combustion engines. More particularly, this invention is concerned with an evaporative control system and a method for internal combustion engines in which purging is controlled so that the variation of the air-fuel ratio of an internal combustion engine is suppressed when the engine speed of the internal combustion engine falls within a domain in which the rotation cycle of the internal combustion engine is substantially synchronous with the drive cycle of a purging control valve.

2. Description of the Related Art

In general, an evaporative control system for an internal combustion engine comprises a purge passage for communicating a canister, for temporarily preserving fuel vapor stemming from a fuel tank, with an intake passage of an internal combustion engine (hereinafter, an engine), and a purging control valve located in the purge passage. The purging control valve is controlled to open or close at a given duty cycle according to the operated state of the engine. When the rotation cycle of the engine is substantially synchronous with the drive cycle of the purging control valve, gas purged from the canister to the intake passage is absorbed into a specified cylinder. This causes the air-fuel ratio of the cylinder to increase, or in other words, the air-fuel mixture in the cylinder to become rich. The air-fuel ratios of the cylinders into which the purged gas is not absorbed decreases, or in other words, the air-fuel mixtures in the other cylinders becomes lean. Consequently, the air-fuel ratio of the engine varies. The cylinders whose air-fuel mixture become lean may misfire. To solve this problem, an art for changing the drive cycle of the purging control valve to another cycle when the engine speed of the engine falls within a domain in which the rotation cycle of the engine is substantially synchronous with the drive cycle of the purging control valve has been disclosed (Refer to Japanese Unexamined Patent Publication No. 6-241129).

However, in the art disclosed in the Japanese Unexamined Patent Publication No. 6-241129, the drive cycle of the purging control valve is changed abruptly when the engine speed is increased or decreased with the engine speed set at a boundary value of a domain in which the rotation cycle of the engine is substantially synchronous with the drive cycle of the purging control valve. For example, when the duty cycle is about 0% or 100%, the flow rate of purged gas abruptly changes. Consequently, the air-fuel ratio varies. According to the art, the air-fuel ratio that has varied due to the abrupt change in flow rate of purged gas is controlled to equal a target air-fuel ratio by correcting a fuel injection amount. This poses a problem in that it takes much time until the air-fuel ratio of the engine becomes steady and equal to the target air-fuel ratio, and the air-fuel ratio of the engine varies during the time.

Accordingly, an object of the present invention is to solve the foregoing problem, to provide an evaporative control system and a method for an internal combustion engine capable of improving the efficiency in purifying exhaust gas by suppressing the variation of the air-fuel ratio of the engine even if the rotation cycle of the engine is substantially synchronous with the drive cycle of a purging control valve, and to prevent misfiring caused by a lean air-fuel mixture.

SUMMARY OF THE INVENTION

FIG. 1 shows the fundamental configuration of the first aspect of the present invention. An evaporative control system for an internal combustion engine 1 according to the first aspect of the present invention which attempts to solve the foregoing problem comprises a canister 37 for temporarily holding fuel vapor from a fuel tank 15, a purge passage 39 for communicating the canister 37 with an intake passage of the engine 1, a purging control valve 41, located in the purge passage 39, for controlling an amount of purged gas to be taken into the intake passage of the engine 1, an air-fuel ratio sensor 31, located in an exhaust passage of the engine, for detecting the air-fuel ratio of the engine 1, a fuel injection control means A for controlling a fuel injection amount according to an output signal of the air-fuel ratio sensor 31 so that the air-fuel ratio of the engine 1 will be equal to a target air-fuel ratio, and an engine speed detecting means B for detecting the speed of the engine 1. The evaporative control system further comprises a synchronism engine speed domain judging means C for judging whether or not the speed of the engine 1 detected by the engine speed detecting means B falls within a synchronism domain in which synchronism with the drive cycle of the purging control valve 41 is substantially attained, a duty cycle limiting means D that, when the synchronism engine speed domain judging means C judges that the speed of the engine 1 falls within the synchronism engine speed domain, limits a duty cycle which indicates the ratio of the open time of the purging control valve 41 to the drive cycle thereof, to any value within a set range according to the speed of the engine 1, a purge ratio calculating means E that, when the synchronism engine speed domain judging means C judges that the speed of the engine 1 falls within the synchronism domain, causes the duty cycle limiting means D to limit a duty cycle to any value and calculates a purge ratio relative to the duty cycle, and a purging control valve open/close control means F for opening or closing the purging control valve 41 at the duty cycle to provide the purge ratio calculated by the purge ratio calculating means E.

In the evaporative control system for an internal combustion engine according to the first aspect of the present invention, when the speed of the engine is increased or decreased with the engine speed set at about a boundary value of a domain in which the rotation cycle of the engine is substantially synchronous with the drive cycle of the purging control valve, the drive cycle of the purging control valve is not changed, but it is inhibited to set a duty cycle to a value within a range in which the duty cycle is low enough not to bring about the variation of the air-fuel ratio and a range in which the duty cycle is so high that the extent of intermittent flow of purged gas is insignificant and an air-fuel mixture is distributed equally to cylinders. This is because when the duty cycle is set to a value within the range in which the duty cycle is low enough not to bring about the variation of the air-fuel ratio, since an amount of purged gas is small for a fuel injection rate at which fuel is introduced into a combustion chamber of the engine through a fuel injection valve, differences in air-fuel ratio among the cylinders are small. When the duty cycle is set to a value within the range in which the duty cycle is so high that the extent of intermittent flow of purged gas is insignificant, since an air-fuel mixture is distributed equally to the cylinders, the differences in air-fuel ratio among the cylinders are small. Thus, the variation of the air-fuel ratio of the engine is suppressed. Since the drive cycle of the purging control valve is not changed, when the duty cycle is, for example, about 0% or 100%, a flow rate of purged gas will not change abruptly and the air-fuel ratio will not vary. By correcting the fuel injection amount according to an increase or decrease in an amount of purged gas, the air-fuel ratio of the engine is controlled to equal to the target air-fuel ratio.

In the evaporative control system for an internal combustion engine according to the first aspect of the present invention, the duty cycle limiting means D determines according to the elapsed time measured by an elapsed time measuring means G for measuring an elapsed time since the onset of purging control, whether or not the duty cycle should be limited to any value within a set range.

When the elapsed time since the onset of purging control measured by the elapsed time measuring means is short, that is, when an amount of vapor to be absorbed into the canister is so large as to affect the variation of the air-fuel ratio, the duty cycle limiting means limits the duty cycle to any value within the set range so as to suppress the variation of the fuel-air ratio of the engine. When the elapsed time since the onset of purging control is long, that is, when an amount of vapor to be absorbed into the canister becomes small, even if the duty cycle is not limited to any value within the set range, the variation of the air-fuel ratio does not become significant. The duty cycle limiting means does not therefore limit the duty cycle to any value within the set range but gives priority to removal of vapor absorbed into the canister so as to ensure the working capacity of the canister.

FIG. 2 shows the fundamental configuration of the second aspect of the present invention. An evaporative control system for an internal combustion engine 1 according to the second aspect of the present invention attempting to solve the aforesaid problem comprises a canister 37 for temporarily holding fuel vapor from a fuel tank 15, a purge passage 39 for communicating the canister 37 with an intake passage of the engine 1, a purging control valve 41, located in the purge passage 39, for controlling an amount of purged gas to be taken into the intake passage of the engine 1, an air-fuel ratio sensor 31, located in an exhaust passage of the engine 1, for detecting an air-fuel ratio of the engine 1, a fuel injection control means A for controlling a fuel injection amount according to the output signal of the air-fuel ratio sensor 31 so that the air-fuel ratio of the engine 1 will be equal to a target air-fuel ratio, and an engine speed detecting means B for detecting the speed of the engine 1. The evaporative control system for an internal combustion engine further comprises a synchronism engine speed domain judging means C for judging whether or not the speed of the engine 1 detected by the engine speed detecting means B falls within a synchronism domain in which synchronism with the drive cycle of the purging control valve 41 is substantially attained, a purged gas concentration calculating means H for calculating a concentration of the vapor-laden air (purged gas) in a supplied gas into a cylinder of the engine 1 based on a deviation of the air-fuel ratio of the engine 1 occurring at time of executing purging, and correcting the fuel injection amount according to the calculated concentration of the purged gas, a maximum magnitude-of-purging calculating means I for calculating the ratio of a maximum magnitude of purging to an amount of fuel supplied to the engine 1 according to the engine speed of the engine 1, a limit purge ratio calculating means J for calculating a limit purge ratio on the basis of the purged gas concentration calculated by the purged gas concentration calculating means H and the maximum magnitude of purging calculated by the maximum magnitude-of-purging calculating means I, a target purge ratio limiting means K that when the synchronism engine speed domain judging means C judges that the engine speed of the engine 1 falls within the synchronism domain, limits a target purge ratio to a value equal to or smaller than the limit purge ratio calculated by the limit purge ratio calculating means J, a purge ratio calculating means E that, when the synchronism engine speed domain judging means C judges that the engine speed of the engine 1 falls within the synchronism domain, calculates a purge ratio according to the target purge ratio limited to any value by the target purge ratio limiting means K, and a purging control valve open/close control means F for opening or closing the purging control valve 41 at a duty cycle to provide the purge ratio calculated by the purge ratio calculating means E.

In the evaporative control system for an internal combustion engine according to the second aspect of the present invention, when the speed of the engine falls within a domain in which the rotation cycle of the engine is substantially synchronous with the drive cycle of the purging control valve, the ratio of a maximum amount of vapor to an amount of supplied fuel that is set to a value not affecting the variation of the air-fuel ratio of the engine, that is, a limit amount of vapor is calculated. Based on the limit amount of vapor and the purged gas concentration thereof, a limit purge ratio is calculated so that, as the purged gas concentration becomes lower, the flow rate of purged gas increases. A target purge ratio is limited to a value equal to or smaller than the calculated limit purge ratio. Consequently, the variation of the air-fuel ratio occurring during acceleration during which a load increases can be suppressed. Moreover, since the use range of the duty cycle is not specified, the performance of the system in purging control improves. Furthermore, when the purged gas concentration is low, the flow rate of purged gas is raised. This makes it possible to ensure the working capacity of the canister.

An evaporative control method for an internal combustion engine to be implemented in an evaporative control system according to the first aspect of the present invention comprises: a canister 37 for temporarily holding fuel vapor from a fuel tank 15; a purge passage 39 for communicating said canister 37 with an intake passage of said engine 1; a purging control valve 41, located in said purge passage 39, for controlling an amount of purged gas to be taken in said intake passage of said engine; an air-fuel ratio sensor 31, located in an exhaust passage of said engine, for detecting an air-fuel ratio of said engine; and a fuel injection control means A for controlling a fuel injection amount according to an output signal of said air-fuel ratio sensor 31 so that the air-fuel ratio of said engine will equal a target air-fuel ratio. The evaporative control method further comprises the steps of: detecting the speed of the engine; judging whether or not the detected engine speed falls within a synchronism domain in which synchronism with the drive cycle of said purging control valve 41 is substantially attained; when it is judged that the speed of the engine falls within the synchronism domain, limiting a duty cycle, which indicates the ratio of the open time of said purging control valve 41 to the drive cycle thereof, to a value within a set range according to the speed of the engine; when it is judged that the speed of the engine falls within the synchronism domain, calculating a purge ratio relative to the duty cycle limited to any value; and opening or closing said purging control valve 41 at the duty cycle to provide the purge rate calculated in the previous step.

In the evaporative control method according to the first aspect of the present invention the elapsed time since the onset of purging control is measured, and it is determined on the basis of the measured elapsed time whether or not the duty cycle is limited to a value within the set range.

An evaporative control method for an internal combustion engine to be implemented in an evaporative control system according to the second aspect of the present invention comprises: a canister 37 for temporarily holding fuel vapor from a fuel tank 15; a purge passage 39 for communicating said canister 37 with an intake passage of said engine 1; a purging control valve 41, located in said purge passage 39, for controlling an amount of purged gas to be taken in said intake passage of said engine; an air-fuel ratio sensor 31, located in an exhaust passage of said engine, for detecting an air-fuel ratio of said engine; a fuel injection control means A for controlling a fuel injection amount according to an output signal of said air-fuel ratio sensor 31 so that the air-fuel ratio of said engine will equal a target air-fuel ratio; and an engine speed detecting means for detecting the speed of the engine. The evaporative control method further comprises the steps of: detecting the speed of the engine; judging whether or not the detected engine speed falls within a synchronism domain in which synchronism with the drive cycle of said purging control value 41 is substantially attained; calculating a concentration of a purged gas in a gas supplied to cylinder of said engine according to a deviation of the air-fuel ratio of said engine occurring at the time of executing purging; correcting the fuel injection amount according to the calculated purged gas concentration; calculating the ratio of a maximum magnitude of purging to an amount of fuel supplied to said engine according to the speed of the engine; calculating a limit purge ratio on the basis of the calculated purged gas concentration and maximum magnitude of purging; when it is judged that the speed of the engine falls within the synchronism domain, limiting a target purge ratio to a value equal to or smaller than the limit purge ratio; when it is judged that the speed of the engine falls within the synchronism domain, calculating a purge ratio according to the target purge ratio; and opening or closing said purging control valve 41 at the duty cycle to provide the purge rate calculated in the previous step.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

The preferred embodiments of the present invention will be described in detail below with reference to the accompanying drawings.

Figure 1:
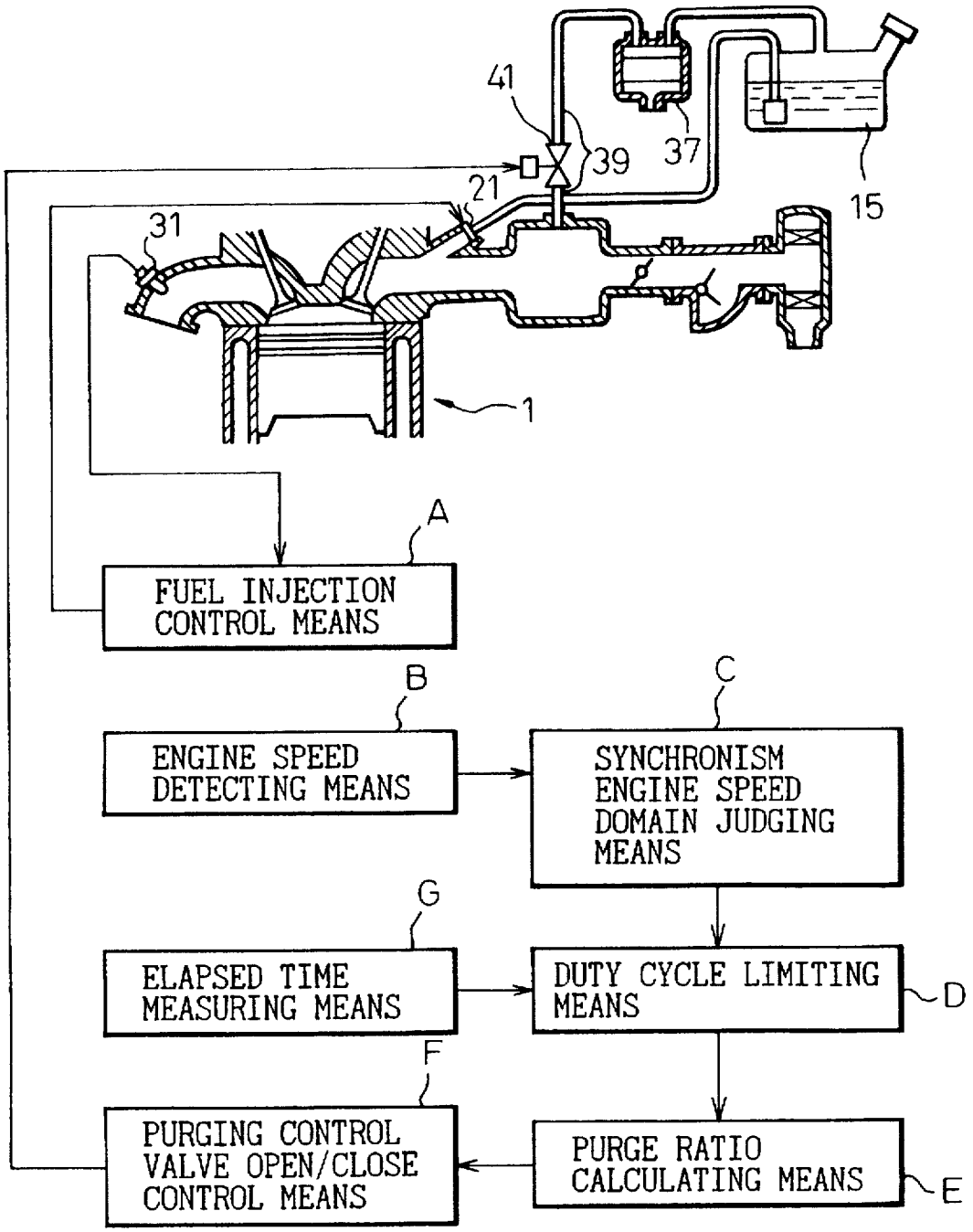
FIG. 1 shows the fundamental configuration of the first aspect of the present invention.
Figure 2:
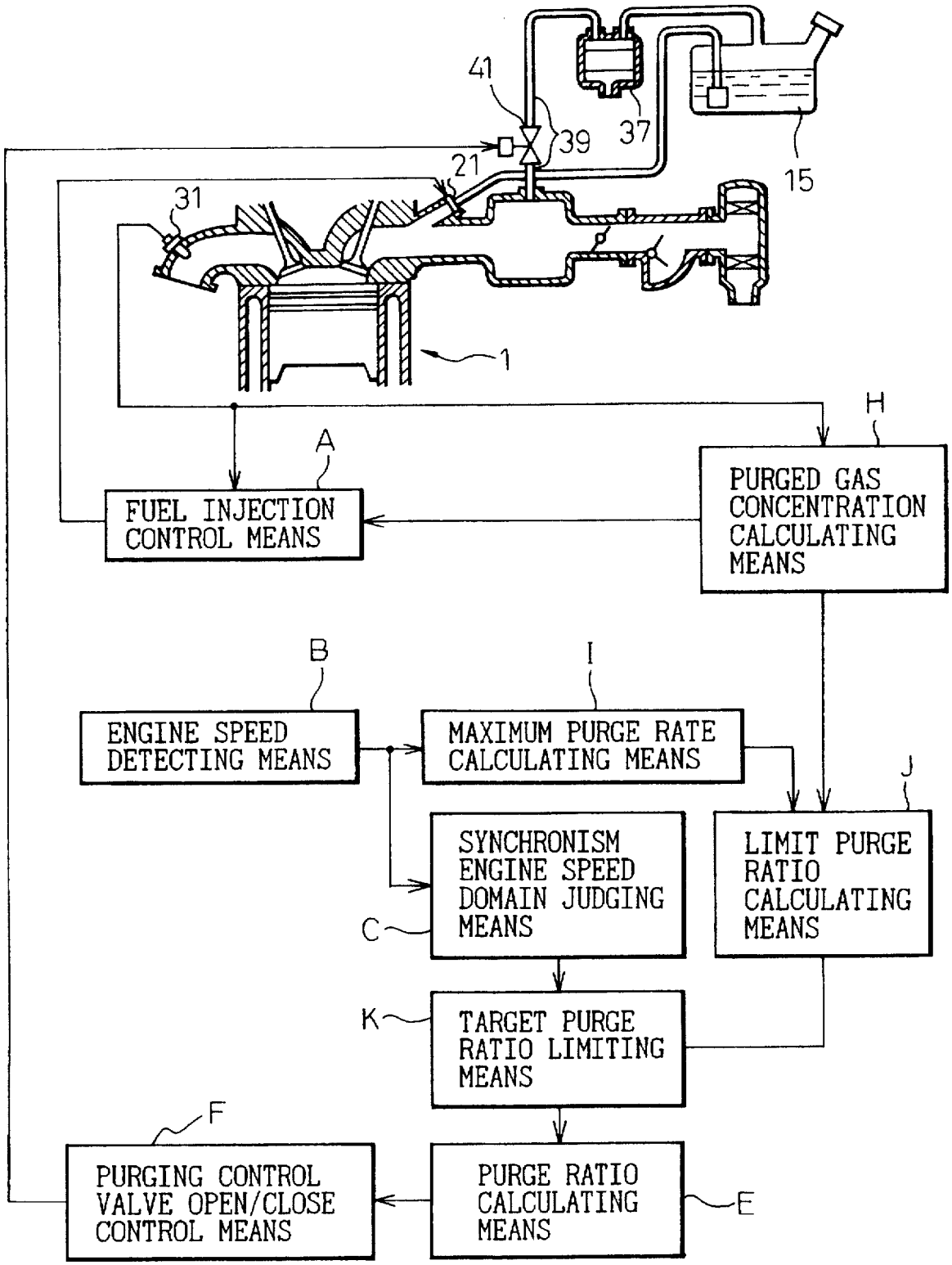
FIG. 2 shows the fundamental configuration of the second aspect of the present invention.
Figure 3:
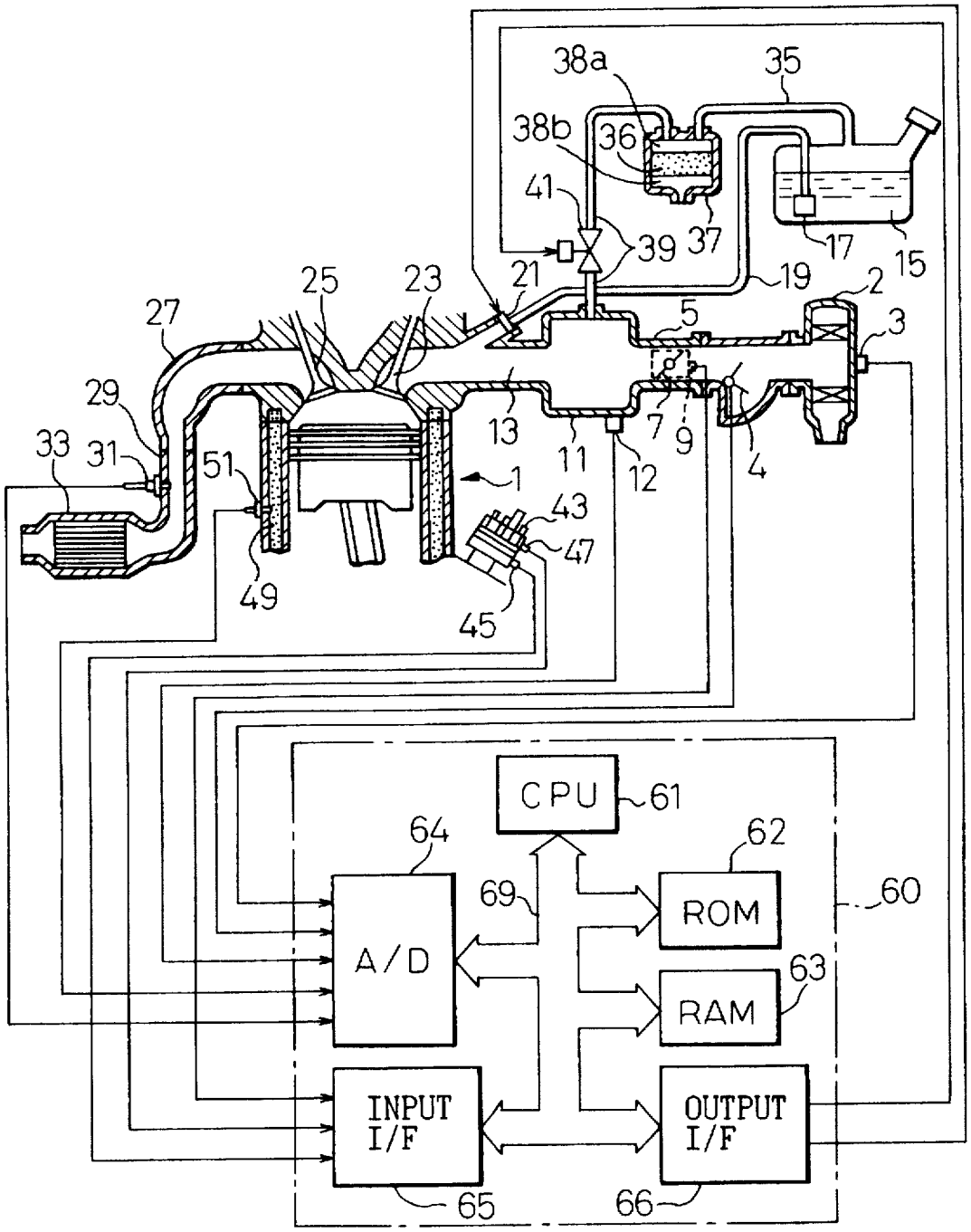
FIG. 3 shows the overall configuration of an evaporative control system for an internal combustion engine in accordance with an embodiment of the present invention.

FIG. 3 shows the overall configuration of an evaporative control system for an internal combustion engine in accordance with an embodiment of the present invention. Air required for combustion in an engine 1 is filtered by an air cleaner 2, passes through a throttle body 5, and is distributed into the intake pipe 13 linked to cylinders through a surge tank 11. An amount of intake air is adjusted by a throttle valve 7 located in the throttle body 5 and measured by an airflow meter 4. The aperture of the throttle valve 7 is detected by a throttle aperture sensor 9. The temperature of intake air is detected by an intake temperature sensor 3. The pressure of the intake pipe is detected by a vacuum sensor 12.

Fuel held in a fuel tank 15 is pumped up by a fuel pump 17 and injected into the intake pipe 13 through fuel injection valves 21 via a fuel tube 19. In the intake pipe 13, the air and fuel are mixed. The air-fuel mixture is taken into the engine body, that is cylinders 1, through an intake valve 23. In each of the cylinders 1, the air-fuel mixture is compressed by a piston. Thereafter, the mixture is ignited by an igniter and spark plug, and then burns. Consequently, motive power is generated.

An ignition distributor 43 includes a reference position detection sensor 45 for generating a reference position detection pulse at 720° intervals of a crank angle (CA) of a crank rotating about a crankshaft, and a crank angle sensor 47 for generating a position detection pulse at intervals of a crank angle of 30°. The engine 1 is cooled by cooling water led into a cooling water passage 49. The temperature of the cooling water is detected by a water temperature sensor 51.

The combusted air-fuel mixture is discharged as exhaust gas into an exhaust manifold 27 through an exhaust valve 25, and then introduced into an exhaust pipe 29. The exhaust pipe 29 has an air-fuel ratio sensor 31 for detecting an oxygen concentration in the exhaust gas. A catalyst converter 33 is located in a downstream exhaust system. A three-way catalyst for facilitating both oxidation of a non-combusted component HC of the exhaust gas and carbon monoxide (CO) and reduction of nitrogen oxides is accommodated in the catalyst converter 33. Thus, exhaust gas purified by the catalyst converter 33 is discharged to the air.

The engine further includes a canister 37 accommodating activated carbon (absorbent) 36. The canister 37 has a fuel vapor chamber 38*a* and an air chamber 38*b* on both sides of the activated carbon 36. The fuel vapor chamber 38*a* is coupled to the fuel tank 15 via a vapor collection tube 35 in one way, and coupled to the downstream intake passage from the throttle valve 7, that is, the surge tank 11 via a purge passage 39 in the other way. The purge passage 39 has a purging control valve 41 for controlling an amount of purged gas. In this arrangement, fuel vapor generated in the fuel tank 15, that is, vapor, is introduced into the canister 37 via the vapor collection tube 35, absorbed into the activated carbon (absorbent) 36 in the canister 37, and thus temporarily preserved in the canister 37. When the purging control valve 41 opens, since the pressure of the intake pipe is a negative pressure, air passes through the activated carbon 37 from the air chamber 38*b*, and is fed into the purge passage 39. When air passes through the activated carbon 36, fuel vapor absorbed in the activated carbon 36 is removed from the activated carbon 36. Thus, air containing fuel vapor is introduced into the surge tank 11 via the purge passage 39, and used as fuel in the cylinders 1 together with fuel injected through the fuel injection valves 21. Vapor introduced into the purge passage 39 includes not only vapor introduced into the purge passage after temporarily being preserved in the activated carbon 36 but also vapor introduced from the fuel tank 15 directly into the purge passage 39.

An electronic control unit (hereinafter ECU) 60 for the engine 1 is a microcomputer system for executing a fuel injection control procedure that will be described in detail later, and an ignition timing control procedure in which the state of the engine is judged comprehensively from the engine speed of the engine and signals sent from the sensors, optimal ignition timing is determined, and then an ignition signal is sent to the igniter. According to the programs stored in a ROM 62, a CPU 61 inputs input signals from the various sensors via an A/D converter 64 or input interface 65. Based on the input signals, computation is executed. Based on the results of the computation, control signals are output to various actuators via an output interface 66. A RAM 63 is used as a temporary data storage area in the process of computation and control procedures. Various components of the ECU 60 are interconnected over a system bus (composed of an address bus, data bus, and control bus) 69. The control given by the ECU 60 will be described below.

Figure 4:
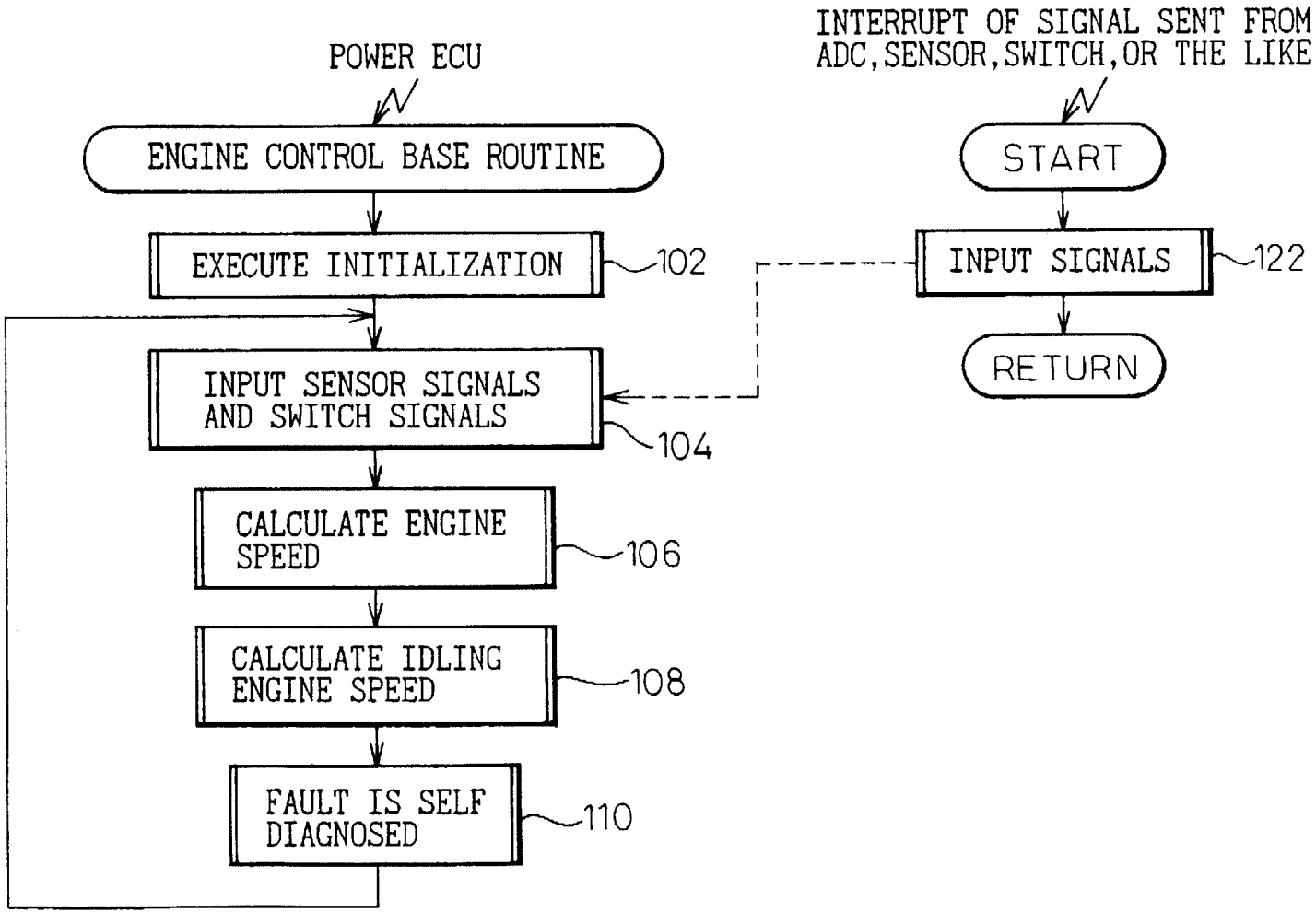
FIG. 4 is a summarized flowchart describing a basic control procedure in the engine of the embodiment of the present invention.
Figure 5:
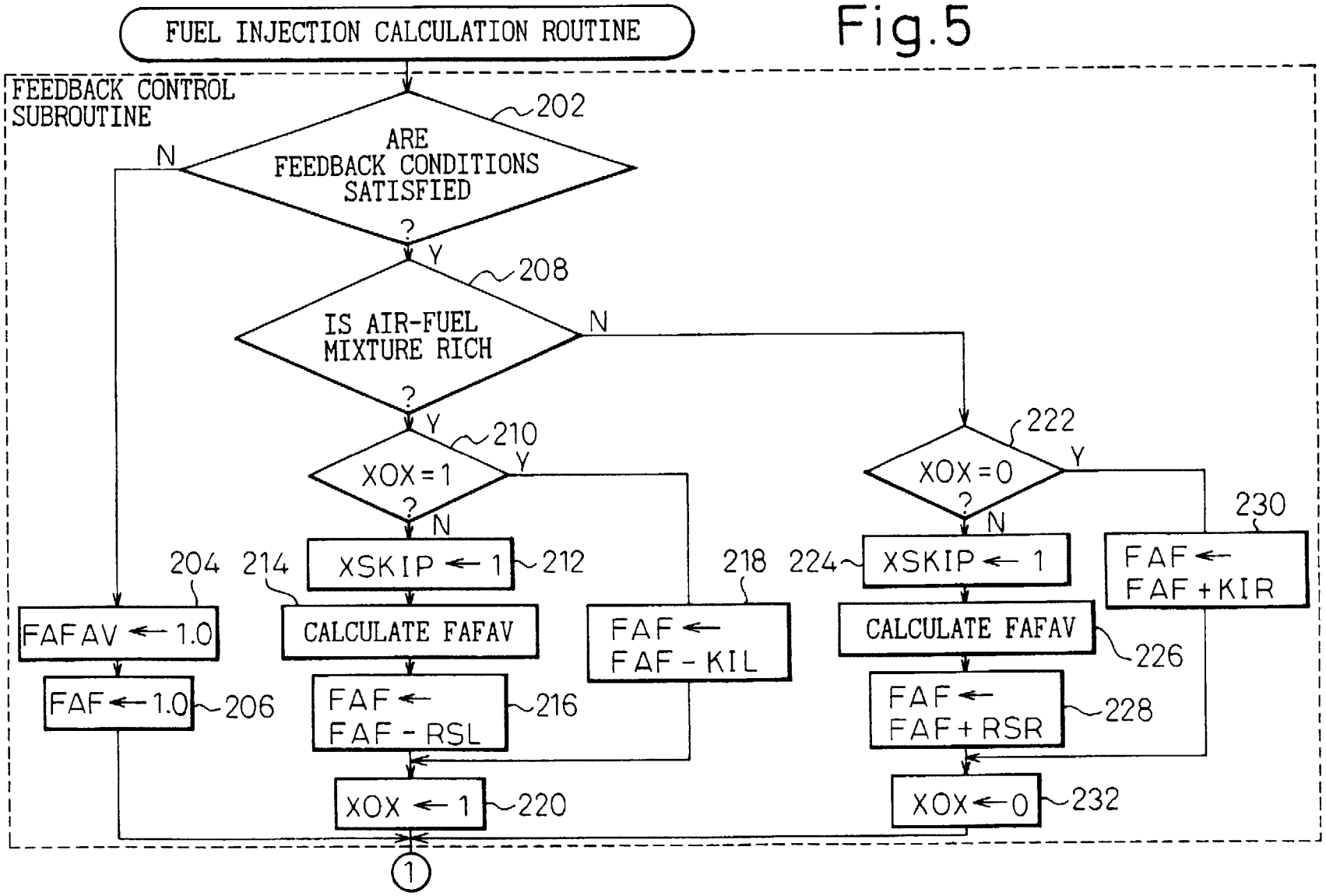
FIG. 5 is a summarized flowchart describing a control procedure for air-fuel ratio feedback in the embodiment of the present invention.
Figure 6:
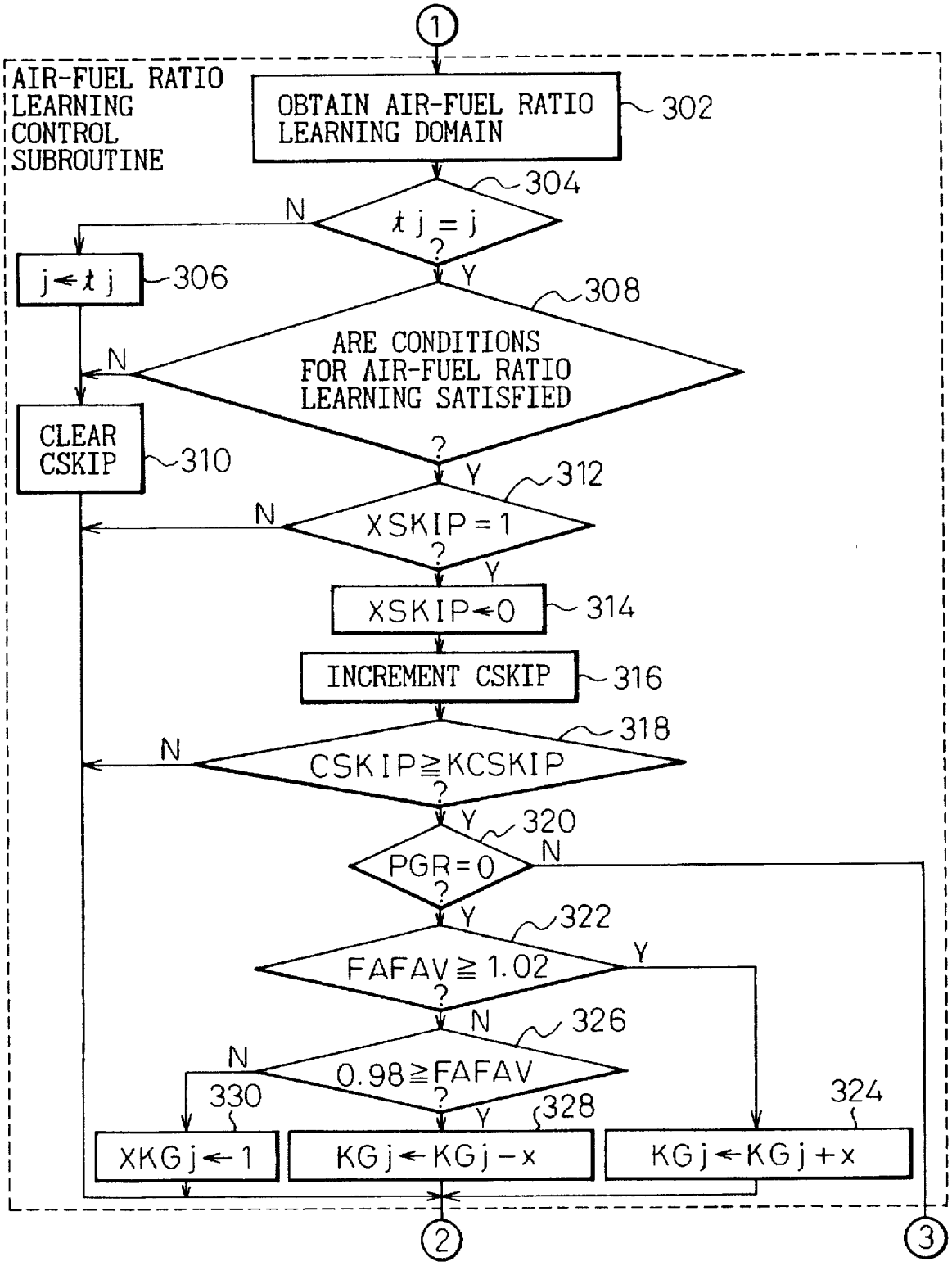
FIG. 6 is a summarized flowchart describing a control procedure for air-fuel ratio learning in the embodiment of the present invention.
Figure 7:
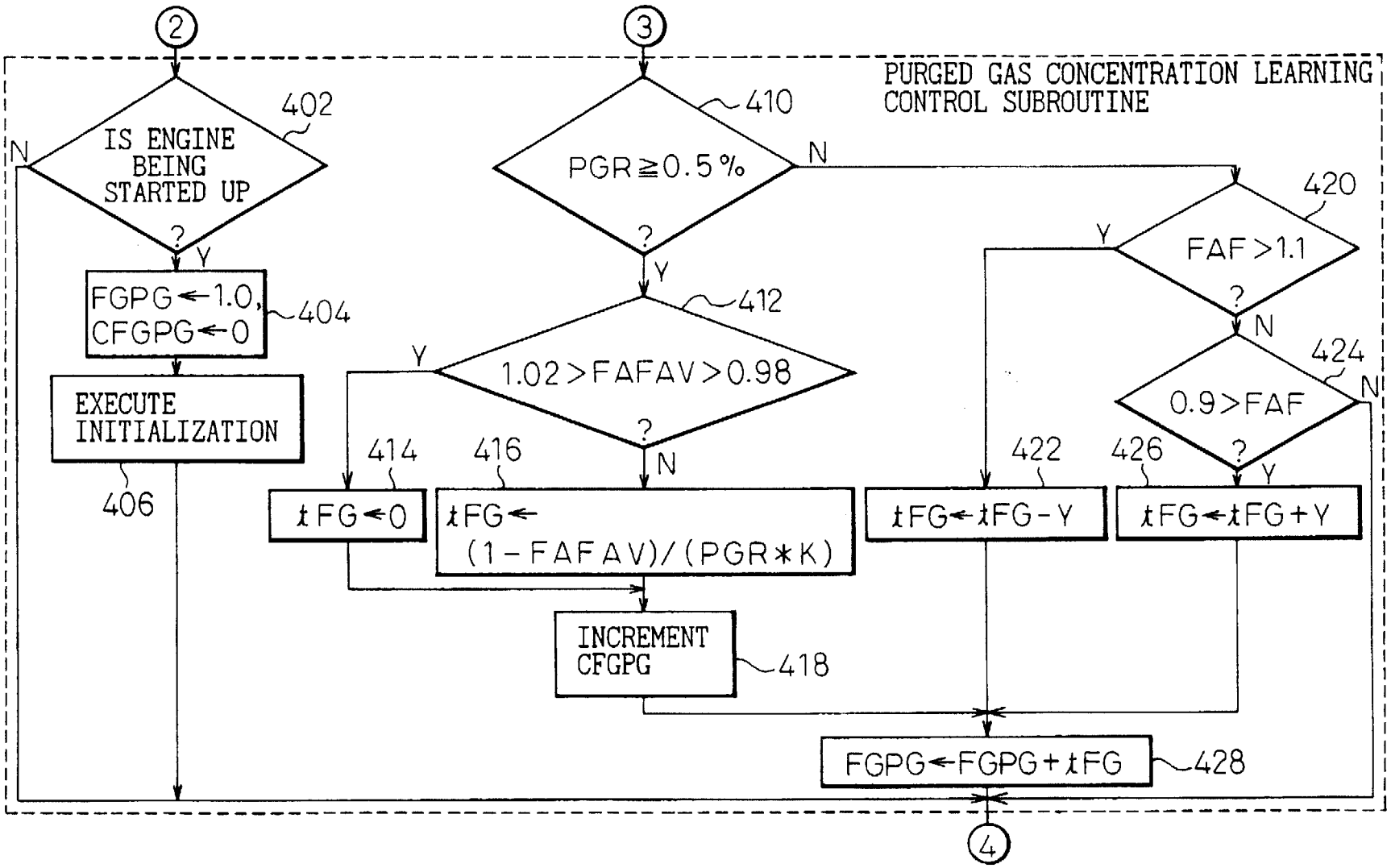
FIG. 7 is a summarized flowchart describing a control procedure for purged gas concentration learning in the embodiment of the present invention.

FIG. 4 is a summarized flowchart describing a basic control procedure in the engine in accordance with the embodiment of the present invention. The ECU 60 executes a loop that is a base routine. During the processing of the base routine, a change in input signal, a rotation made by the engine, or timed processing is handled as an interrupt. As shown in FIG. 4, when the power supply of the ECU 60 is turned on, first, the ECU 60 executes a given initialization (step 102). Thereafter, sensor signals and switch signals are input (step 104), the speed of the engine is calculated (engine speed detecting means B) (step 106), the idling engine speed is calculated (step 108), and a self fault diagnosis is performed (step 110). These operations are executed repeatedly. An output signal or output signals sent from an A/D converter (ADC) or some sensors or switches is fetched as an interrupt (step 122). Moreover, the results of calculating timing according to which fuel is injected into each cylinder and of calculating ignition timing must be output to an associated actuator synchronously with a rotation. The output is therefore executed as an interrupt process to handle a signal sent from a crank angle sensor 47. Other processing to be executed at intervals of a certain time is executed as a timer interrupt routine.

A fuel injection control procedure (fuel injection control means A) is basically arranged such that a fuel injection amount, that is, an injection time during which fuel is injected through a fuel injection valve 21 is computed on the basis of an amount of intake air measured by the airflow meter 4 and an engine speed detected by the crank angle sensor 47, and fuel is injected when a given crank angle is attained. Meanwhile, various kinds of correction are carried out: fundamental correction based on signals sent from a throttle aperture sensor 9, a water temperature sensor 51, and an intake temperature sensor 3; air-fuel ratio feedback correction based on a signal sent from an air-fuel ratio sensor 31; air-fuel ratio learning correction in which a mean value of feedback correction values is made equal to a stoichiometric air-fuel ratio; and correction based on the results of canister purging (for example, correction to be carried out by a purged gas concentration calculating means H). The present invention relates, in particular, to canister purging and fuel injection amount correction based on the results of canister purging. Hereinafter, a fuel injection amount calculation routine and purging control routine (to be initiated with an interrupt output from a timer) relevant to an evaporative control procedure of the present invention will be described in detail.

Figure 8:
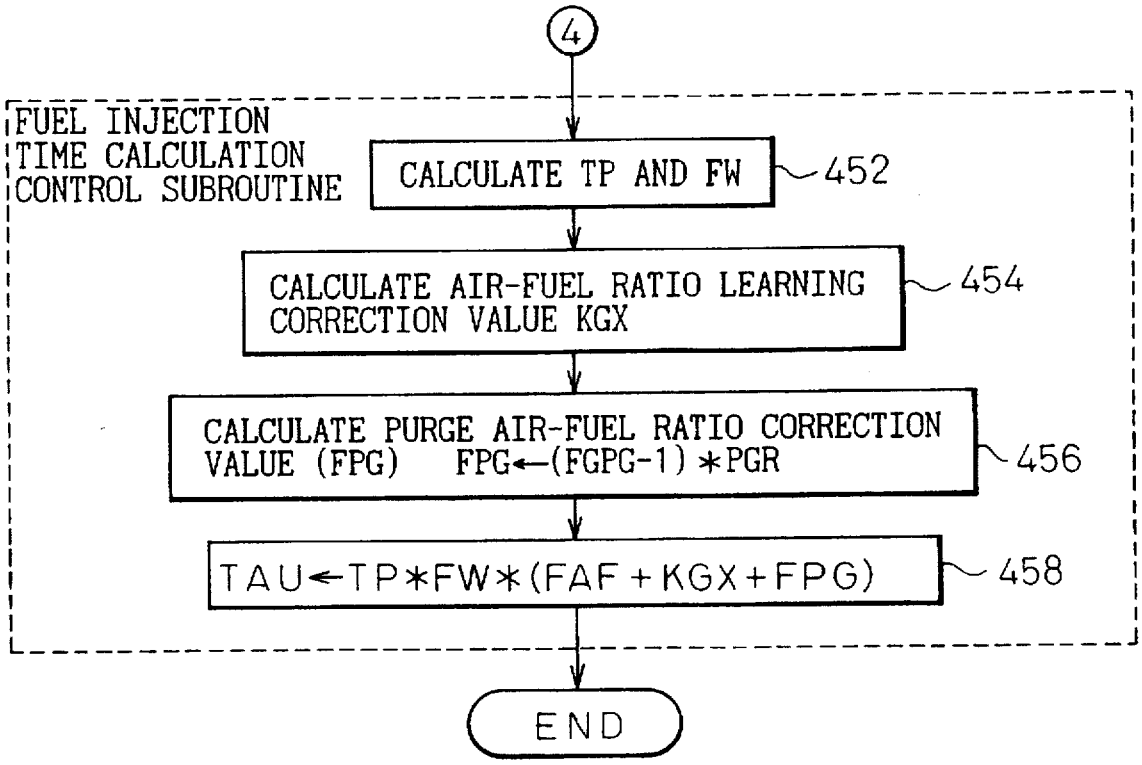
FIG. 8 is a summarized flowchart describing a control procedure for fuel injection time calculation in the embodiment of the present invention.

FIGS. 5 to 8 are summarized flowcharts describing the procedure for fuel injection amount calculation in accordance with an embodiment of the present invention. The fuel injection amount calculation routine is a routine to be invoked with an interrupt generated by a timer at intervals of a given time (for example, 1 msec.), and composed of an air-fuel ratio (AF) feedback (F/B) control subroutine (FIG. 5), an air-fuel ratio (A/F) learning control subroutine (FIG. 6), a purged gas concentration learning control subroutine (purged gas concentration calculating means H) (FIG. 7), and a fuel injection time (TAU) calculation control subroutine (FIG. 8). These control subroutines will be described successively, starting with the air-fuel ratio feedback control subroutine.

The air-fuel ratio feedback control subroutine first judges whether or not all the following conditions for air-fuel ratio feedback are satisfied (step 202):

(1) the engine has not been started up;

(2) fuel cut (F/C) control is not executed;

(3) the temperature of cooling water is equal to or higher than 40° C.; and (4) the air-fuel ratio sensor has been activated.

When the result of the judgment is in the affirmative, it is judged whether the air-fuel ratio indicates that the air-fuel mixture is rich, that is, whether the output voltage of the air-fuel ratio sensor 31 is equal to or lower than a reference voltage (for example, 0.45 V) (step 208).

If the result of the judgment made at step 208 is in the affirmative, that is, if the air-fuel ratio indicates that the air-fuel mixture is rich, whether or not the previous air-fuel ratio also indicated that the air-fuel mixture was rich is judged from whether or not an air-fuel ratio rich flag XOX is set to 1 (step 210). If the result of judgment is in the negative, that is, the previous air-fuel ratio indicated that the air-fuel mixture was lean, the current air-fuel ratio indicates an opposite state. In this case, a skip flag XSKIP is set to 1 (step 212). An average FAFAV between an air-fuel ratio feedback correction coefficient FAF obtained immediately before the previous skip and an FAF obtained immediately before the current skip is calculated (step 214). A given number of skipped instructions, that is, a given skip level RSL is subtracted from the air-fuel ratio feedback correction coefficient FAF (step 216). If the result of judgment made at step 210 is in the affirmative, that is, if the previous air-fuel ratio also indicated that the air-fuel mixture was rich, a given integral level KIL is subtracted from the air-fuel ratio feedback correction coefficient FAF (step 218). After the execution of step 216 or 218, the air-fuel ratio rich flag XOX is set to 1 (step 220). The feedback control subroutine is terminated. Control is then passed to the next air-fuel ratio learning control subroutine (step 302).

When the result of the judgment made at step 208 is in the negative, that is, when the air-fuel ratio indicates that the air-fuel mixture is lean, whether or not the previous air-fuel ratio also indicated that the air-fuel mixture was lean is judged from whether or not the air-fuel ratio rich flag XOX is reset to 0 (step 222). If the result of the judgment is in the negative, that is, if the previous air-fuel ratio indicated that the air-fuel mixture was rich but the current air-fuel ratio indicates an opposite state, the skip flag XSKIP is set to 1 (step 224). An average FAFAV between an air-fuel ratio feedback correction coefficient FAF obtained immediately before the previous skip and an FAF obtained immediately before the current skip is calculated (step 226). A given skip level RSR is added to the air-fuel ratio feedback correction coefficient FAF (step 228). If the result of the judgment made at step 22 is in the affirmative, that is, if the previous air-fuel ratio also indicated that the air-fuel mixture was lean, a given integral level KIR is added to the air-fuel ratio feedback correction coefficient FAF (step 230). After the execution of step 228 or 230, the air-fuel ratio rich flag XOX is reset to 0 (step 232). The feedback control subroutine is then terminated, and control is passed to the next air-fuel ratio learning control subroutine (step 302).

If the result of the judgment made at step 202 is in the negative, that is, if the conditions for feedback are not satisfied, the average FAFAV and air-fuel ratio feedback correction coefficient FAF are set to a reference value 1.0 (steps 204 and 206). The feedback control subroutine is then terminated, and control is passed to the next air-fuel ratio learning control subroutine (step 302).

Next, the air-fuel ratio control subroutine (FIG. 6) will be described. First, it is detected within which learning domain j (j=1 to 7) the current pressure of the intake pipe falls from among air-fuel ratio learning domains 1 to 7 that are separated in relation to pressures in the intake pipe. The learning domain within which the current pressure of the intake pipe falls is regarded as a learning domain tj (j=1 to 7) (step 302). The pressure of the intake pipe is detected by the vacuum sensor 12. It is then judged whether or not the current learning domain tj agrees with the previous learning domain j (step 304). If they disagree with each other and the learning domain has changed, the current learning domain tj is regarded as a learning domain j (step 306). The number of skips CSKIP is cleared (step 310). The air-fuel ratio learning control subroutine is terminated, and then control is passed to the purged gas concentration learning control subroutine (step 402).

If the result of the judgment made at step 304 is in the affirmative, that is, if the previous learning domain agrees with the previous learning domain, it is judged whether or not all the conditions for air-fuel ratio learning are satisfied (step 308):

(1) the air-fuel ratio feedback control subroutine is in progress;

(2) neither an increase in amount due to after engine start-up nor an increase in amount due to engine warm-up is executed; and (3) the temperature of cooling water is equal to or higher than 80° C. If the conditions are not satisfied, the number of skips CSKIP is cleared (step 310). The air-fuel ratio learning control subroutine is terminated, and control is passed to the purged gas concentration learning control subroutine (step 402).

If the result of the judgment made at step 308 is in the affirmative, that is, if the conditions for air-fuel ratio learning are satisfied, it is judged whether or not the skip flag XSKIP is set to 1, that is, a skip has been made immediately previously (step 312). If the result of the judgment is in the negative, that is, if a skip has not been made immediately previously, the air-fuel ratio learning control subroutine is terminated, and control is passed to the purged gas concentration learning control subroutine (step 402). If the result of the judgment is in the affirmative, that is, a skip has been made immediately previously, the skip flag XSKIP is cleared to 0 (step 314). The number of skips CSKIP is incremented (step 316). It is then judged whether or not the number of skips CSKIP is equal to or larger than a given value KCSKIP (for example, 3) (step 318). If the result of the judgment is in the negative, the air-fuel ratio learning control subroutine is terminated, and control is passed to the purged gas concentration learning control subroutine (step 402).

If the result of the judgment made at step 318 is in the affirmative, it is judged whether or not a purge ratio PGR calculated by the purging control routine to be described later is 0 (step 320). If the result of the judgment is in the negative, that is, if purging is in progress, the air-fuel ratio learning control subroutine is terminated, and control is passed to the purged gas concentration learning control subroutine (step 410). On the other hand, if the purge ratio PGR is 0, that is, purging is not in progress, a learning value KGj (j=1 to 7) included in the learning domain j is changed according to whether or not the FAFAV value set at step 204, 214, or 226 within the feedback control subroutine is deviated by a given value (for example, 2%) or larger. That is to say, if the FAFAV value is equal to or larger than 1.02 (judged in the affirmative at step 322), the learning value KGj is raised by a given value x (step 324). If the FAFAV value is equal or or smaller than 0.98 (judged in the affirmative at step 326), the learning value KGj is lowered by the given value x (step 328). In any other case, an air-fuel ratio learning completion flag XKGj associated with the learning domain j is set to 1 (step 330). After the air-fuel ratio learning control subroutine is thus terminated, control is passed to the purged gas concentration learning control subroutine (step 402). The purge ratio PGR is expressed as the ratio of an amount of intake air to an amount of purged gas.

Next, the purged gas concentration learning control subroutine (FIG. 7) will be described. First, at step 402, it is judged whether or not the engine is being started. In other words, it is judged whether or not the engine speed indicates that the engine is being started after an ignition key is turned ON. If the engine is not being started, the purged gas concentration learning control subroutine is terminated, and control is passed to the fuel injection time calculation control subroutine (step 452). If the engine is being started, a purged gas concentration FGPG is set to a reference value 1.0, and a purged gas concentration update frequency CFGPG is cleared to 0 (step 404). Other initialization routines are executed, and then, for example, a purged gas concentration update value tFG is set to 0 (step 406). The purged gas concentration learning control subroutine is then terminated.

If the result of the judgment made at step 320 within the air-fuel ratio learning control subroutine is in the negative, that is, if the conditions for air-fuel ratio learning are satisfied and purging is in progress, control is passed to step 410. At step 410, it is judged whether or not the purge ratio PGR is equal to or larger than a given value (for example, 0.5%). If the result of the judgment is in the affirmative, it is judged whether or not a deviation of the FAFAV value from the reference value 1.0 falls within a given range (±2%) (step 412). If the deviation falls within the range, a purged gas concentration update value tFG dependent on a purge ratio is set to 0 (step 414). If the deviation does not fall within the range, the purged gas concentration update value tFG dependent on the purge ratio is calculated according to the following expression (step 416):

$$tFG=(1-FAFAV)/(PGR*k)$$

where k denotes a given value (for example, 2). The purged gas concentration update frequency CFGPG is then incremented (step 418), and control is passed to step 428.

If the result of the judgment made at step 410 is in the negative, that is, if the purge ratio PGR is smaller than 0.5%, it is judged that the accuracy in updating a purged gas concentration is poor. It is therefore judged whether or not a deviation of the air-fuel ratio feedback correction coefficient FAF from the reference value 1.0 is large (for example, ±10% or larger). In other words, if the FAF value is larger than 1.1 (judged in the affirmative at step 420), the purged gas concentration update value tFG is decreased by a given value Y (step 422). If the FAF value is smaller than 0.9 (judged in the negative at step 420 and in the affirmative at step 424), the purged gas concentration update value tFG is increased by the given value Y (step 426). Finally, at step 428, the purged gas concentration FGPG is corrected by the purged gas concentration update value tFG calculated through the foregoing processing. The purged gas concentration learning control subroutine is then terminated, and control is passed to the fuel injection time calculation control subroutine (step 452).

Next, the fuel injection time calculation control subroutine (FIG. 8) will be described. First, data stored in the form of a map in the ROM 62 is referenced to determine a reference fuel injection time TP on the basis of the engine speed and load (an amount of intake air per rotation of the engine). Based on the signals sent from the throttle aperture sensor 9, water temperature sensor 51, intake temperature sensor 3, and the like a reference correction coefficient FW is calculated (step 452). The engine load may be estimated on the basis of the pressure of the intake pipe and the engine speed. Thereafter, an air-fuel ratio learning correction value KGX associated with the current pressure of the intake pipe is calculated by performing interpolation on an air-fuel ratio learning value KGj included in an adjoining learning domain (step 454).

A purge air-fuel ratio correction value FPG is calculated using the purged gas concentration FGPG and purge ratio PGR according to the following expression (step 456):

$$FPG=(FGPG-1)*PGR$$

Finally, a fuel injection time TAU is calculated according to the following expression (step 458):

$$TAU=TP*FW*(FAF+KGX+FPG)$$

Thus, the fuel injection amount calculation routine is terminated. The fuel injection valve 21 associated with each cylinder 1 is controlled to open with the crank set at a given crank angle during only the thus calculated fuel injection time TAU.

Figure 9A:
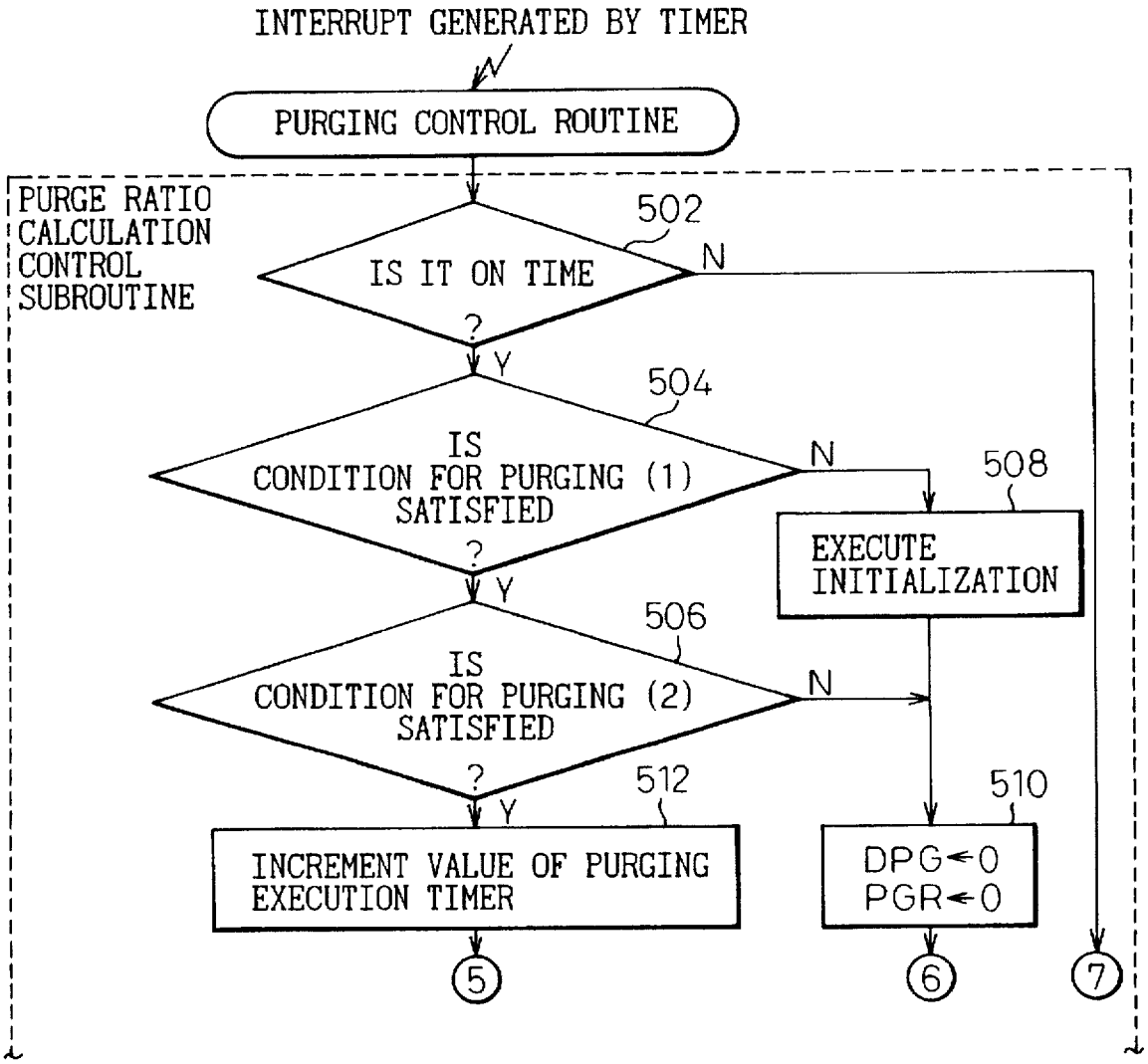
FIGS. 9A and 9B show a summarized flowchart describing a control procedure for purge ratio calculation in the embodiment of the present invention.
Figure 9B:
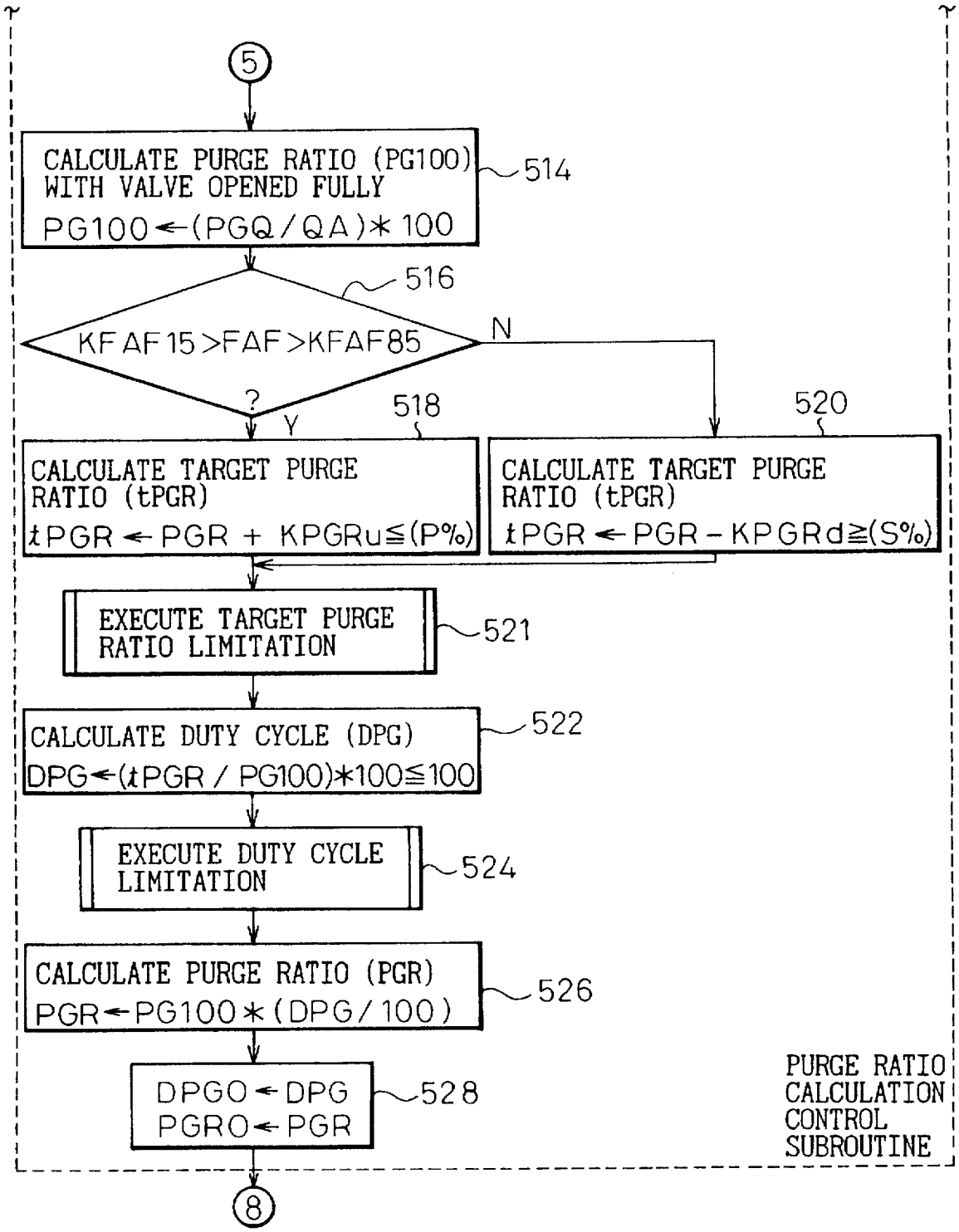
Figure 10:
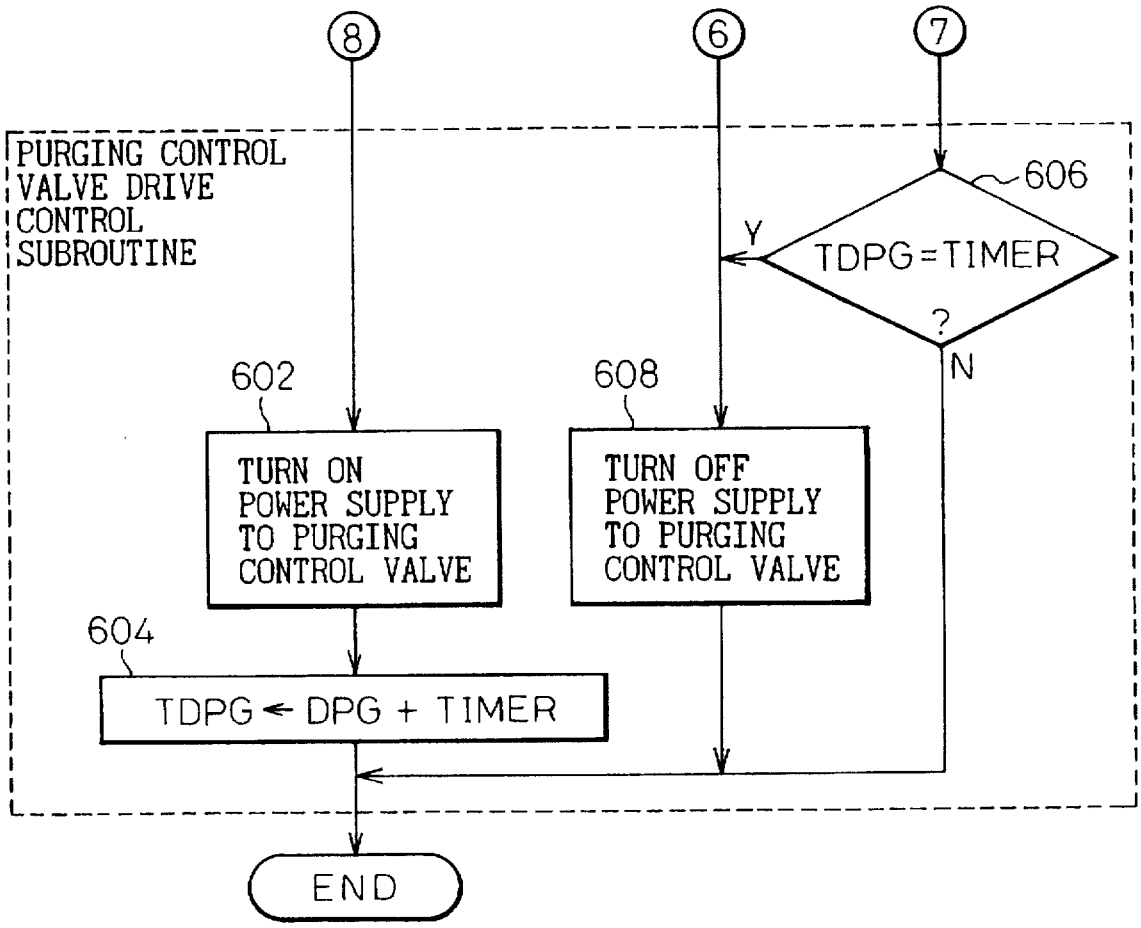
FIG. 10 is a summarized flowchart describing a control procedure for purging control valve driving in the embodiment of the present invention.

FIGS. 9A, 9B and 10 are summarized flowcharts describing a control procedure for purging in the embodiment of the present invention. The purging control routine is a routine to be invoked with an interrupt generated at intervals of a given time (for example, 1 msec.), determines a duty cycle (the ratio of the ON time of a pulsating signal to the OFF time thereof) of a pulsating signal used to control the aperture of the purging control valve D-VSV 41 for controlling an amount of purged gas, and controls drive of the purging control valve 41 using the pulsating signal. This routine is composed of a purge ratio (PGR) calculation control subroutine (FIGS. 9A and 9B) and purging control valve (D-VSV) drive control subroutine (FIG. 10). The purge ratio calculation control subroutine will be described first.

The purge ratio calculation control subroutine (purge ratio calculating means E) (FIGS. 9A and 9B) first judges whether or not the run time of this routine coincides with a period during which a pulsating signal for controlling the purging control valve can be turned ON, that is, a given ON time (for example, 100 msec. when the driving frequency of the purging control valve is 10 Hz) (step 502). If the run time coincides with the ON time, it is judged if the condition for purging (1) is satisfied, that is, all the conditions for air-fuel ratio learning except the condition that fuel cut control is not executed are satisfied (step 504). If the condition for purging (1) is satisfied, it is judged if the condition for purging (2) is satisfied, that is, if fuel cut control is not executed and the air-fuel ratio learning completion flag XKGj associated with the learning domain j is set to 1 (step 506).

Figure 11:
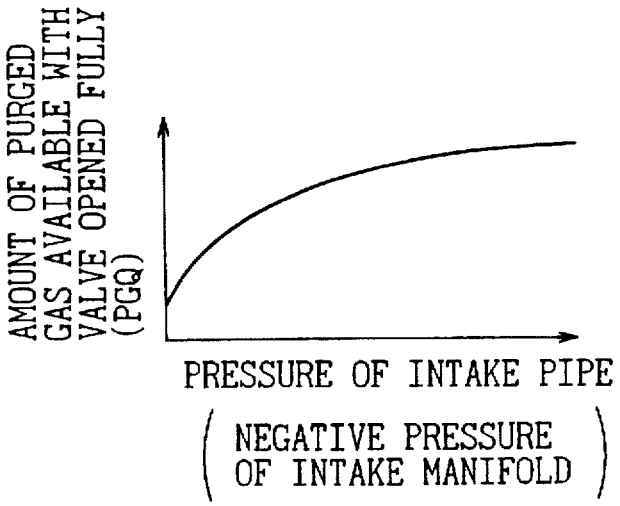
FIG. 11 is a characteristic graph expressing the relationship between the pressure of an intake pipe and the amount of purged gas attainable with a purge control valve fully open.

If the condition for purge (2) is satisfied, first, a purging execution timer CPGR is incremented (elapsed time measuring means G) (step 512). The map shown in FIG. 11 (stored in the ROM 62) is referenced using the current pressure of the intake pipe as a key, whereby an amount of purged gas PGQ available with the purge control valve fully open is determined. The ratio of the amount of purged gas PGQ to an amount of intake air QA is calculated to obtain a purge ratio PG100 attainable with the purging control valve opened fully (step 514). It is then judged whether or not the air-fuel ratio feedback correction coefficient FAF falls within a given range (from a constant KFAF 85 to a constant KFKF 15) (step 516).

Figure 12:
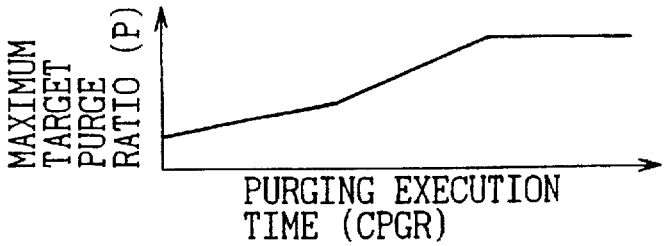
FIG. 12 is a characteristic graph expressing the relationship between the purge execution time and the maximum target purge ratio.

If the result of the judgment made at step 516 is in the affirmative, a target purge ratio tPGR is raised by a given value KPGRu. The target purge ratio tPGR to be obtained is limited to a value equal to or smaller than a maximum target purge ratio P% determined on the basis of a purging execution time CPGR (obtained from the map shown in FIG. 12) (step 518). If the result of the judgment made at step 516 is in the negative, the target purge ratio tPGR is lowered by a given value KPGRd. Similarly to step 518, the target purge ratio tPGR to be obtained is limited to a value equal to or larger than a minimum target purge ratio S%, for example, S=0% (or 0.5%). The variation of the air-fuel ratio deriving from purging is thus prevented.

According to the fifth embodiment, the limitation that is the feature of the second aspect of the present invention is executed for the thus obtained target purge ratio tPGR (step 521). According to the first to fourth embodiments, step 521 is skipped. The target purge ratio limitation will be described later in detail using the fifth embodiment. The target purge ratio limiting means K of the present invention is realized by executing step 524. Based on the thus obtained target purge ratio tPGR and the purge ratio PG100 attainable with the purging control valve opened fully, a duty cycle DPG is calculated according to the following expression (step 522):

$$DPG=(tPGR/PG100)*100$$

According to the first to fourth embodiments, the limitation that is the feature of the first aspect of the present invention is executed for the duty cycle DPG calculated as mentioned above (step 524). According to the fifth embodiment, step 524 is skipped. The duty cycle limitation will be described later in detail in conjunction with the first to fourth embodiments. The duty cycle limiting means D of the present invention is realized by executing step 524.

In consideration of the possibility that the duty cycle DPG may be updated through duty cycle limitation of step 524, an actual purge ratio PGR is calculated according to the following expression (step 526):

$$PGR=PG100*(DPG/100)$$

Finally, based on the thus obtained duty cycle DPG and purge ratio PGR, the contents of memory areas DPG0 and PGRO in which the previous duty cycle and purge ratio are stored are updated (step 528). Control is then passed to step 602 of the purging control valve drive control subroutine.

If it is judged at step 502 that the run time does not coincide with the ON time, control is passed to step 606 of the purging control valve drive control subroutine. Although the run time coincides with the ON time, if the condition for purging (1) is not satisfied, relevant data in the RAM, for example, the preceding duty cycle DPGO, purge ratio PGRO, and purging execution timer CPGR are cleared to 0s for initialization (step 508). After the execution of step 508 or, if the condition for purging (2) is not satisfied at step 506, the duty cycle DPG and purge ratio PGR are cleared to 0s (step 510). Control is then passed to step 608 of the purging control valve drive control subroutine.

Next, the purging control valve drive control subroutine (purging control valve open/close control means F) (FIG. 10) will be described. First, at step 602 to be executed after step 528 of the purge ratio control subroutine, the power supply to the purging control valve is turned ON. At step 604, a time instant TDPG at which the conduction of the purging control valve comes to an end is calculated according to the following expression:

$$TDPG=DPG+TIMER$$

where TIMER denotes the value of a counter to be incremented every time the purging control routine is executed.

At step 606 to be executed when it is judged at step 502 that the run time does not coincide with the ON time, it is judged whether or not the current TIMER value agrees with the purging control valve conduction end time instant TDPG. If the TIMER value disagrees with the time instant TDPG, the subroutine is terminated. If they agree with each other, control is passed to step 608. If the result of the judgment made at step 510 or 606 is in the affirmative, control is passed to step 608. At step 608, the power supply of the purging control valve is turned OFF, and the subroutine is terminated. Thus, the purging control routine is completed. Hereinafter, a duty cycle limitation subroutine (step 524) within the purging control routine (FIGS. 9A and 9B) in accordance with the present invention will be described in detail. To begin with, the relationship between the variation of an air-fuel ratio deriving from purging control according to a prior art and the duty cycle will be described.

Figure 13:
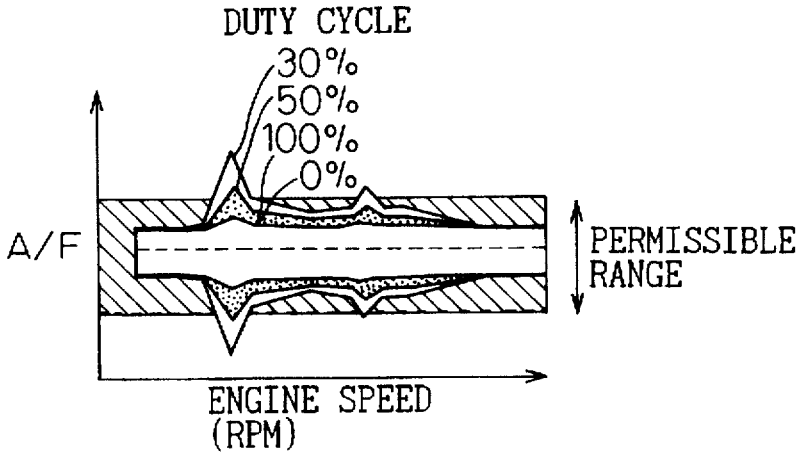
FIG. 13 is a diagram showing the variation in an air-fuel ratio derived from purging control in a prior art.

FIG. 13 shows the variation in an air-fuel ratio derived from purging control according to a prior art. In the purging control according to the prior art, a limitation is not imposed on a duty cycle. When the engine speed falls within a synchronism domain in which the rotation cycle of the engine is substantially synchronous with the drive cycle of the purging control valve, the magnitude of the variation of an air-fuel ratio exceeds a permissible range at a duty cycle ranging, for example, from 15% to 80%. This results in deterioration of purifying exhaust gas.

The present invention attempts, as mentioned at the beginning, to suppress the variation of an air-fuel ratio of an engine even if the rotation cycle of the engine is substantially synchronous with the drive cycle of a purging control valve. In the first embodiment according to the first aspect of the present invention, consideration is taken into the fact that when a duty cycle ranges from 15% to 80%, an air-fuel ratio varies greatly. When the engine speed falls within a synchronism domain in which the rotation cycle of the engine is substantially synchronous with the drive cycle of the purging control valve, it is inhibited that the duty cycle is set to a value ranging from 15% to 80%. This is because when the duty cycle is set to a value within a range (0% to 15%) in which the duty cycle is low enough not to bring about the variation of the air-fuel ratio, since an amount of purged gas is small for a fuel injection amount at which fuel is introduced into the combustion chamber of the engine through a fuel injection valve, differences in air-fuel ratio among cylinders are small. When the duty cycle is set to a value within a range (80% to 100%) in which the duty ratio is so high that the extent of intermittent flow of purged gas is insignificant, since an air-fuel mixture is distributed equally to the cylinders, differences in air-fuel ratio among the cylinders are small. The first embodiment will be described below.

Figure 14:
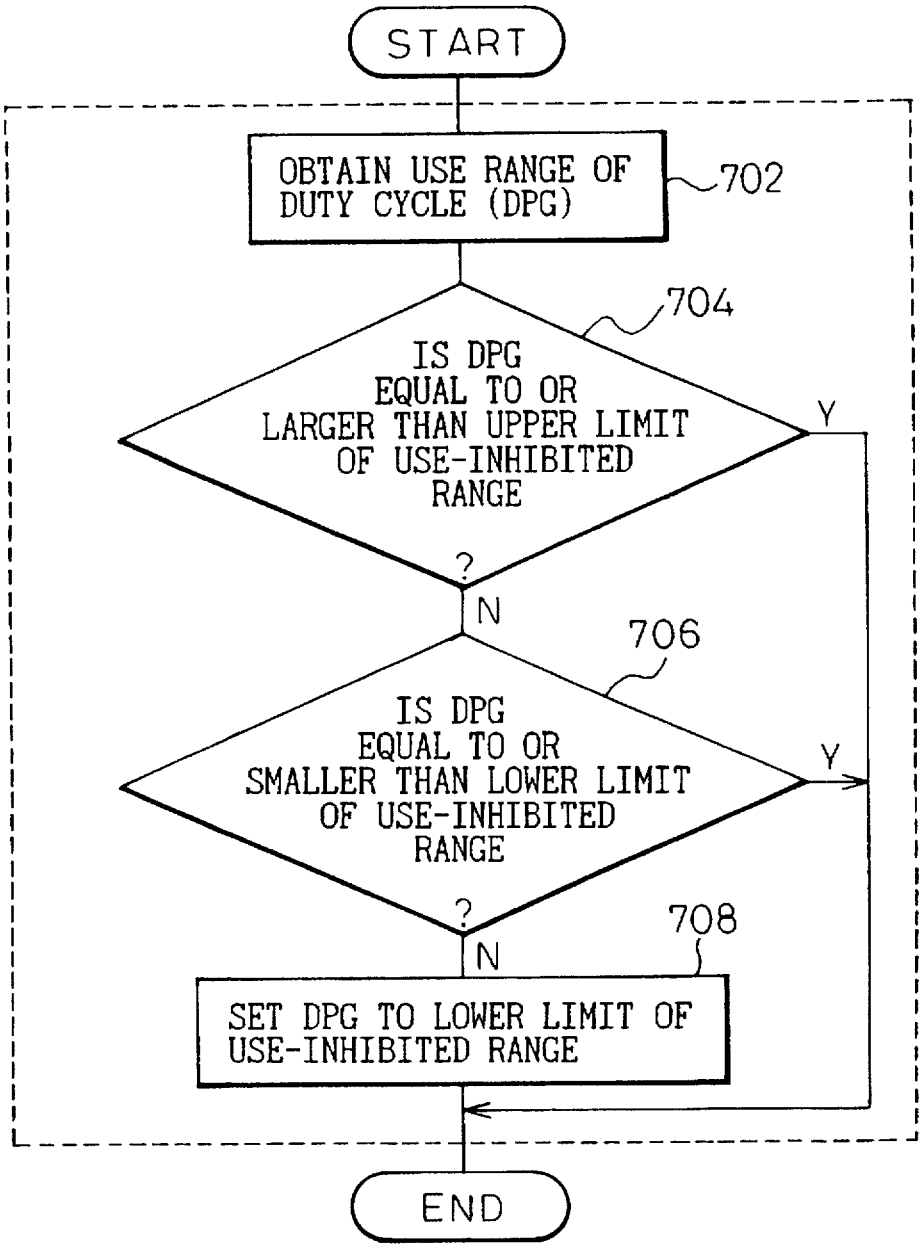
FIG. 14 is a flowchart describing the procedure of duty cycle limitation in the first embodiment.
Figure 15:
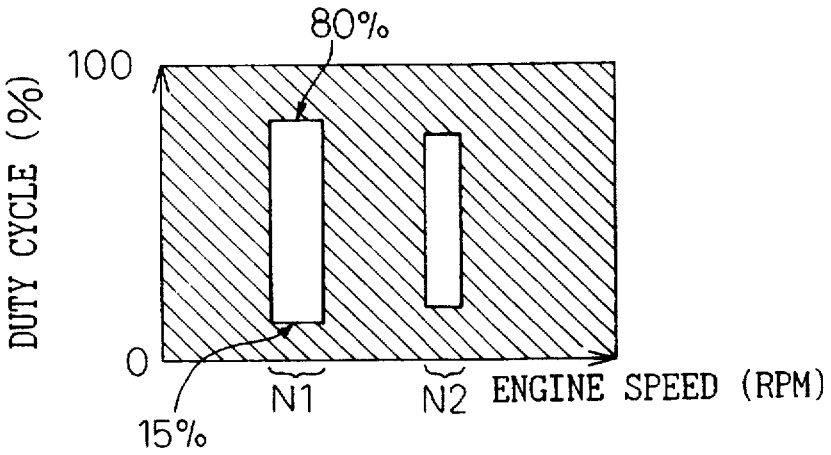
FIG. 15 shows a map used to specify use-inhibited ranges of a duty cycle in the first embodiment.
Figure 20:
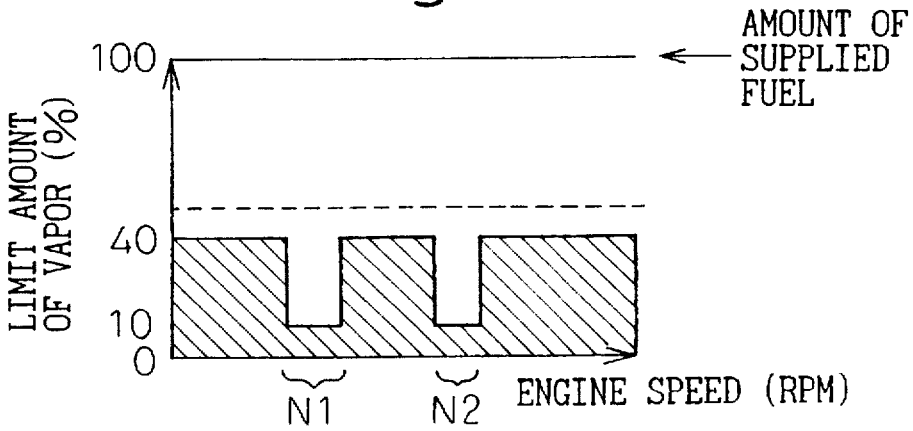
FIG. 20 shows a map used to calculate a limit amount of vapor in the fifth embodiment.

FIG. 14 is a flowchart describing the procedure of duty cycle limitation of the first embodiment. First, at step 702, duty cycle use-inhibited ranges are obtained from a map shown in FIG. 15. In the map shown in FIG. 15, the axis of abscissae indicates the engine speed of an engine (RPM), and the axis of ordinates indicates the duty cycle (%). Synchronism domains N1 and N2 of the engine speed in which the rotation cycle of the engine is substantially synchronous with the drive cycle of a purging control valve are specified experimentally. A range from 15 to 80% of the duty cycle that when the engine speed falls within either of the domains N1 and N2, brings about the variation of the air-fuel ratio is use-inhibited. That is to say, it is inhibited that the duty cycle is set to any value except a value within a range from 0 to 15% in which the duty cycle is low enough not to bring about the variation of the air-fuel ratio and a range from 80 to 100% in which the duty cycle is so high that the extent of intermittent flow of purged gas is insignificant and the air-fuel mixture is distributed equally to cylinders. When the engine speed falls within the synchronism domain N2, the influence of an amount of purged gas upon the variation of the air-fuel ratio is so small that the use-inhibited range of the duty cycle is narrow. The synchronism engine speed domain judging means C of the present invention is realized with the maps shown in FIGS. 15, 17, and 20.

At step 704, the duty cycle DPG calculated at step 522 described in FIG. 9B is compared with an upper limit of the inhibited range, for example, 80% (DPG≧80). If the result of the judgment is in the affirmative, the subroutine is terminated. Control is passed to step 526. If the result of the judgment is in the negative, control is passed to step 706. At step 706, the duty cycle DPG is compared with a lower limit of the inhibited range, for example, 15% (DPG≦15). If the result of the judgment is in the affirmative, the subroutine is terminated and control is passed to step 526. If the result of the judgment is in the negative, control is passed to step 708. At step 708, the duty cycle DPG is set to the lower limit of the inhibited range, 15%.

Figure 16:
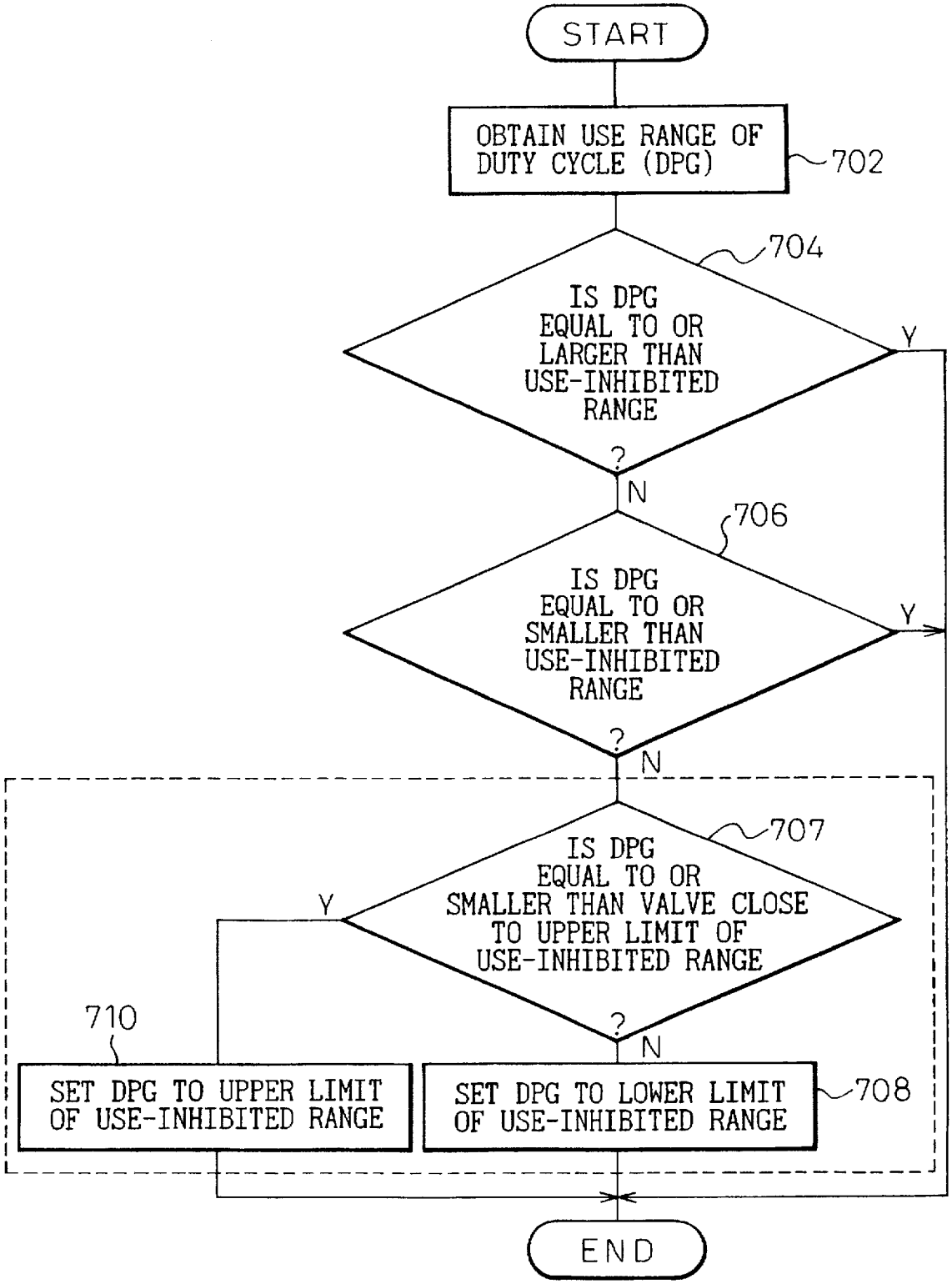
FIG. 16 is a flowchart describing the procedure of duty cycle limitation in the second embodiment.

FIG. 16 is a flowchart describing the procedure of duty cycle limitation in accordance with the second embodiment. A difference from the first embodiment shown in FIG. 14 is that judgment step 707 is inserted between steps 706 and 708. The judgment is such that it is judged whether or not the duty cycle DPG calculated at step 522 is close to the upper limit of the inhibited range. If the result of the judgment is in the affirmative, control is passed to step 710. The duty cycle DPG is then set to the upper limit of the inhibited range, 80%. If the result of the judgment is in the negative, control is passed to step 708. The duty cycle DPG is then set to the lower limit of the inhibited range, 15%. This leads to improvement of purging control efficiency.

Figure 17:
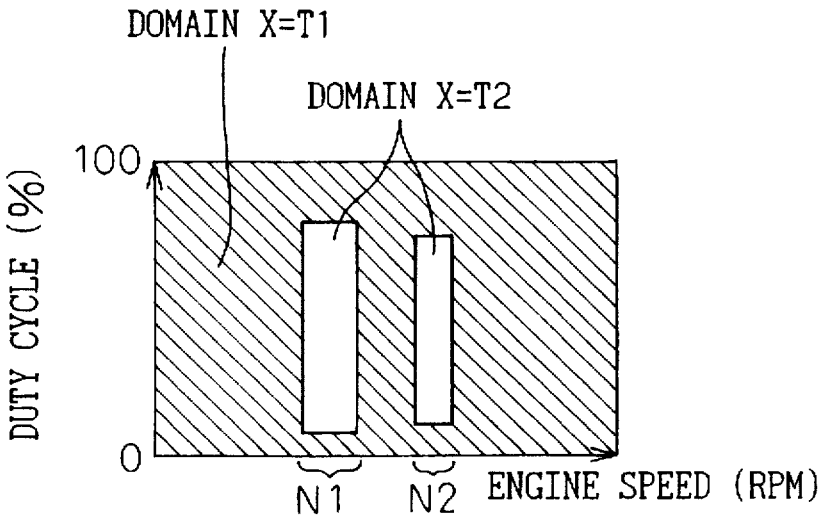
FIG. 17 shows a map used to obtain the drive cycle of a purging control valve in the third embodiment.

FIG. 17 shows a map used to calculate the drive cycle of a purging control valve in accordance with the third embodiment. As shown in FIG. 17, two cycles T1 and T2 are specified for the drive cycle of the purging control valve. When the engine speed falls within either of the synchronism domains N1 and N2 (domain $X_2$) in which the rotation cycle of the engine is substantially synchronous with the drive cycle of the purging control valve, if the duty cycle DPG calculated at step 522 falls within a range from about 15% to 80% that brings about the variation of the air-fuel ratio, the drive cycle of the purging control valve is set to cycle T2. When the duty cycle falls within a range from about 0% to 15% or a range from 80% to 100% that does not bring about the variation of the air-fuel ratio, the drive cycle of the purging control valve is set to cycle T1. When the engine speed falls outside domain $X_1$ of the synchronism domains N1 and N2, the variation of the air-fuel ratio will not occur. The drive cycle of the purging control valve is therefore set to cycle T1. Owing to this purging control, when the engine speed falls within either of the synchronism domains N1 and N2 (domain $X_1$), the variation of the air-fuel ratio can be suppressed.

Figure 18:
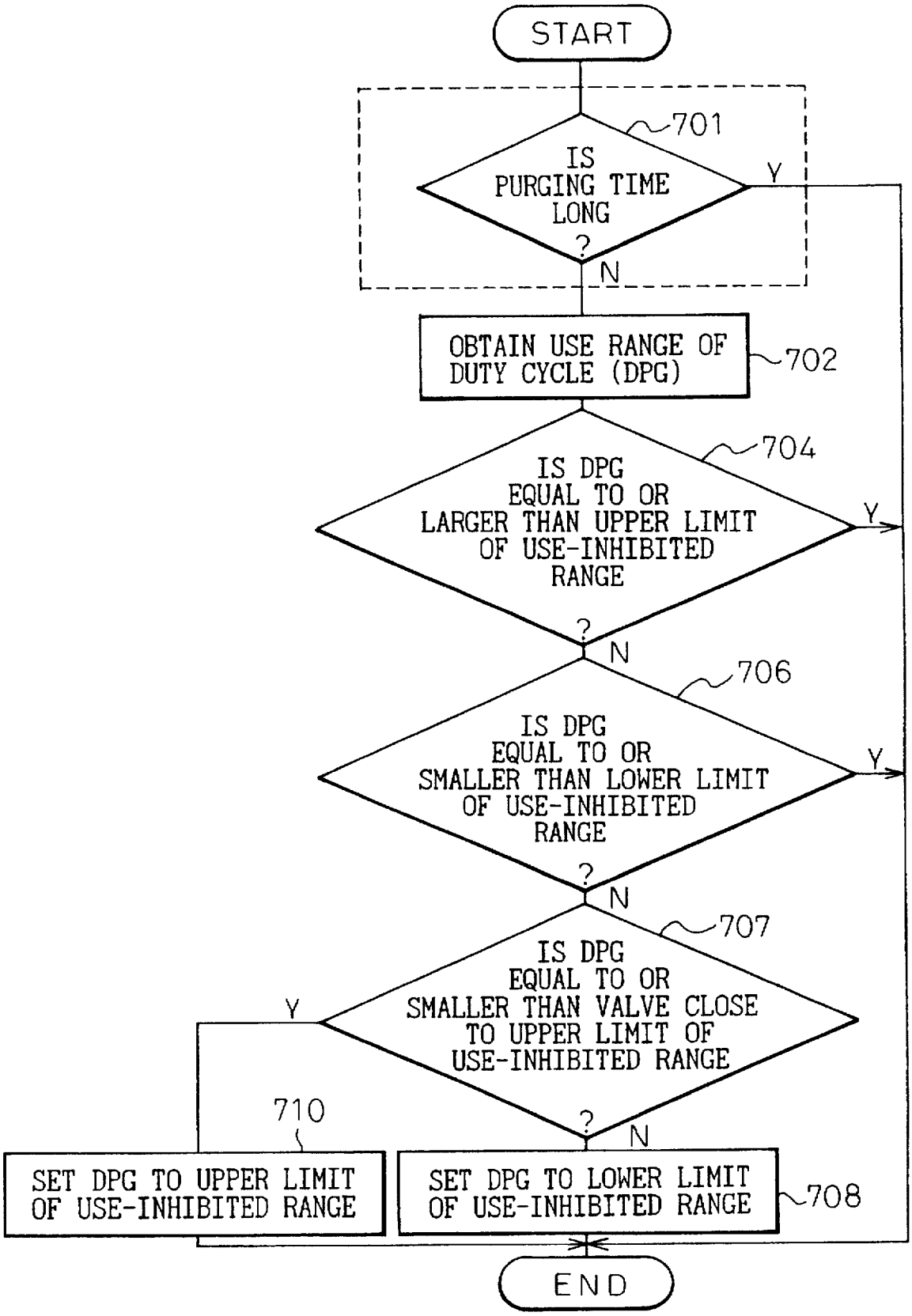
FIG. 18 is a flowchart describing the procedure of duty cycle limitation in the fourth embodiment.

FIG. 18 is a flowchart describing the procedure of duty cycle limitation in accordance with the fourth embodiment. The fourth embodiment is an embodiment in which an elapsed time since the onset of purging control which is measured by a purging execution timer CPGR is used for the duty cycle limiting means. As described at the beginning, based on the elapsed time measured by the purging execution timer CPGR, when the elapsed time since the onset of purging control is short, that is, when an amount of fuel vapor to be absorbed into the canister is so large as to affect the variation of an air-fuel ratio, the duty cycle is limited to a value within a set range in order to suppress the variation of an air-fuel ratio of an engine. When the elapsed time since the onset of purging control is long, that is, when an amount of fuel vapor to be absorbed into the canister becomes small, even if the duty cycle is not limited to a value within the set range, the variation of the air-fuel ratio will not become significant. The duty cycle is therefore not limited to a value within the set range. The flowchart of FIG. 18 is identical to that of FIG. 16 concerning the second embodiment except step 701. Step 701 alone will therefore be described. At step 701, based on the the value of the purging execution timer CPGR described in conjunction with step 512 in FIG. 9, it is judged whether or not about 20 to 30 min. has elapsed since the onset of purging control. If the result of the judgment is in the affirmative, this subroutine is terminated, and control is passed to step 522. If the result of the judgment is in the negative, control is passed to step 702, and the same processing as that described in the second embodiment is executed. By executing the fourth embodiment, purging control efficiency improves, and the working capacity of the canister is ensured. Next, the fifth embodiment according to the second aspect of the present invention will be described. In the fifth embodiment, a limit purge ratio is calculated on the basis of a purged gas concentration. A target purge ratio is limited to a value equal to or smaller than the calculated limit purge ratio. Thus, the variation of the air-fuel ratio occurring during acceleration during which a load increases is suppressed.

Figure 19:
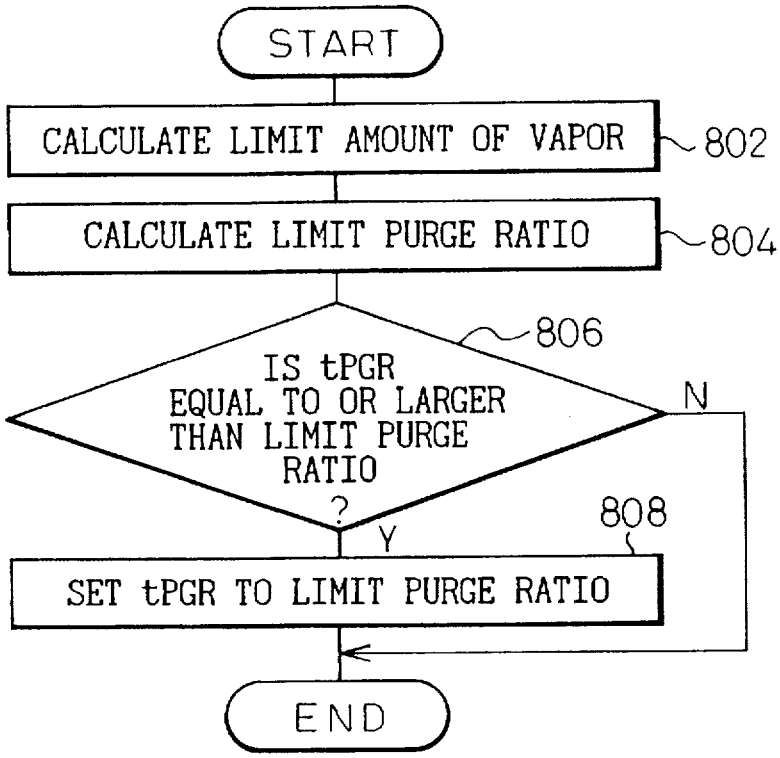
FIG. 19 is a flowchart describing the procedure of target purge ratio limitation in the fifth embodiment.

FIG. 19 is a flowchart describing the procedure of duty cycle limitation of the fifth embodiment. First, at step 802, a limit amount of vapor is obtained from a map shown in FIG. 20. In the map shown in FIG. 20, the axis of abscissa indicates the engine speed of an engine (rpm), and the axis of ordinates indicates a limit amount of vapor (%). Synchronism domains Ni and N2 of the engine speed in which the rotation cycle of the engine is substantially synchronous with the drive cycle of a purging control valve are specified experimentally. When the engine speed falls within either of the synchronism domains N1 and N2, the ratio of an amount of vapor to an amount of fuel supplied to a cylinder, 100%, is limited to a certain value. More specifically, when the engine speed falls within either of the synchronism domains N1 and N2, the ratio of a maximum limit amount of vapor to the amount of supplied fuel 100% is set to, for example, 10%. When the engine speed falls outside the synchronism domains N1 and N2, the ratio is set to, for example, 40%. At step 804, a limit purge ratio is calculated on the basis of the limit amount of vapor set at step 802 and the purged gas concentration FGPG calculated at step 428 in FIG. 7 according to the following expression:

limit purge ratio=limit amount of vapor/purged gas concentration (FGPG)

The limit purge ratio calculating means J of the present invention is realized by executing step 804. At step 806, the target purge ratio tPGR calculated at step 518 or 520 in FIG. 9B is compared with the limit purge ratio calculated at step 804. If the tPGR value is equal to or larger than the limit purge ratio, control is passed to step 808. If the tPGR value is smaller than the limit purge ratio, this routine is terminated, and control is passed to step 522 in FIG. 9B. At step 808, the target purge ratio tPGR is set to the limit purge ratio calculated at step 804.

According to the foregoing second aspect of the present invention, a limit purge ratio is calculated on the basis of a purged gas concentration, and a target purge ratio is limited to a value equal to or smaller than the limit purge ratio. The variation of the air-fuel ratio occurring, especially, during acceleration during which a load increases, can be suppressed.

As described above, in the evaporative control system for internal combustion engines according to the first aspect of the present invention, when the engine speed of the engine is increased or decreased with the engine speed set to a value close to a boundary value of a domain in which the rotation cycle of the engine is substantially synchronous with the drive cycle of the purging control valve, it is prohibited that the duty cycle is set to any value except a value within a range in which the duty cycle is low enough not to bring about the variation of the air-fuel ratio without the necessity of changing the drive cycle of the purging control valve, and a range in which the duty cycle is so high that the extent of intermittent flow of purged gas is insignificant and an air-fuel mixture is distributed equally into cylinders. Consequently, the variation of the air-fuel ratio of the engine can be suppressed. Eventually, the exhaust gas can be further purified.

In the evaporative control system for an internal combustion engine according to the first aspect of the present invention, when the elapsed time since the onset of purging control is short, that is, when an amount of vapor to be absorbed into the canister is so large as to affect the variation of the air-fuel ratio, the duty cycle is limited to a value within a set range in order to suppress the variation of the air-fuel ratio of the engine. When the elapsed time since the onset of purging control is long, that is, when the amount of vapor to be absorbed into the canister becomes small, even if the duty cycle is not limited to a value within the set range, the variation of the air-fuel ratio will not become significant. The duty cycle is therefore not limited to a value within the set range, but priority is given to removal of vapor absorbed into the canister in order to ensure the working capacity of the canister. This leads to improvement of purging control efficiency.

As described so far, in the evaporative control system for internal combustion engines according to the second aspect of the present invention, a limit purge ratio is calculated on the basis of the ratio of a limit amount of vapor, which is set so as not to affect the variation of the air-fuel ratio of the engine, to an amount of supplied fuel, and a purged gas concentration. A target purge ratio is limited to a value equal to or smaller than the limit purge ratio. Consequently, the variation of the air-fuel ratio occurring, especially, during acceleration during which a load increases can be suppressed. Moreover, since the use range of the duty cycle is not specified, the performance of the engine in purging control can be improved. Furthermore, when a purged gas concentration is low, the flow rate of purged gas is increased. The working capacity of the canister can therefore be ensured.

It will be understood by those skilled in the art that the foregoing descriptions are preferred embodiments of the disclosed system and method, and that various changes and modification may be made in the invention without departing from the spirit and scope thereof.

What is claimed is:

1. An evaporative control system for an internal combustion engine comprising:

a canister for temporarily holding fuel vapor from a fuel tank;

a purge passage for communicating the canister with an intake passage of the engine;

a purging control valve, located in the purge passage, for controlling an amount gas purged into the intake passage;

an air-fuel ratio sensor, located in an exhaust passage of the engine, for detecting an air-fuel ratio of the engine;

fuel injection control means for controlling a fuel injection amount according to an output signal of the air-fuel ratio sensor so that the air-fuel ratio of the engine approaches a target air-fuel ratio;

engine speed detecting means for detecting the speed of the engine;

synchronism engine speed domain judging means for judging whether the detected speed of the engine falls within a synchronism domain in which a drive cycle of the purging control valve is substantially synchronous with the detected engine speed;

duty cycle limiting means that, when the speed of the engine falls within the synchronism domain, limits a duty cycle based on the speed of the engine to a value within a set range, wherein the duty cycle indicates a ratio of an open time of the purging control valve to the drive cycle thereof;

purge ratio calculating means that, when the speed of the engine falls within the synchronism domain, calculates a purge ratio relative to the duty cycle limited by the duty cycle limiting means; and purging control valve open/close control means for opening and closing the purging control valve at the duty cycle to provide the purge ratio calculated by the purge ratio calculating means.

2. An evaporative control system according to claim 1, wherein the duty cycle limiting means determines, on the basis of elapsed time since an onset of purging control measured by an elapsed time measuring means, whether the duty cycle should be limited to a value within the set range.

3. An evaporative control system for an internal combustion engine comprising:

a canister for temporarily holding fuel vapor from a fuel tank;

a purge passage for communicating the canister with an intake passage of the engine;

a purging control valve, located in the purge passage, for controlling an amount gas purged into the intake passage;

an air-fuel ratio sensor, located in an exhaust passage of the engine, for detecting an air-fuel ratio of the engine;

fuel injection control means for controlling a fuel injection amount according to an output signal of the air-fuel ratio sensor so that the air-fuel ratio of the engine approaches a target air-fuel ratio;

engine speed detecting means for detecting the speed of the engine;

synchronism engine speed domain judging means for judging whether the detected speed of the engine falls within a synchronism domain in which a drive cycle of the purging control valve is substantially synchronous with the detected engine speed;

purged gas concentration calculating means for calculating, based on a deviation of the air-fuel ratio during purging, a concentration of the purge gas supplied to a cylinder of the engine and for correcting a fuel injection amount according to the calculated purged gas concentration;

maximum magnitude-of-purging calculating means for calculating, based on the engine speed, a ratio of a maximum magnitude of purging to an amount of fuel supplied to the engine;

limit purge ratio calculating means for calculating a limit purge ratio on the basis of the purged gas concentration and the maximum magnitude of purging;

target purge ratio limiting means that, when the speed of the engine falls within the synchronism domain, limits a target purge ratio to a value at least as small as the limit purge ratio;

purge ratio calculating means that, when the speed of the engine falls within the synchronism domain, calculates a purge ratio according to a target purge ratio limited by the target purge ratio limiting means; and purging control valve open/close control means for opening and closing the purging control valve at the duty cycle to provide the purge ratio calculated by the purge ratio calculating means, wherein the duty cycle indicates a ratio of an open time of the purging control valve to the drive cycle thereof.

4. A method for controlling an evaporative control system in an internal combustion engine, wherein the evaporative control system comprises a canister for temporarily holding fuel vapor from a fuel tank, a purge passage for communicating the canister with an intake passage of the engine, a purging control valve located in the purge passage for controlling an amount gas purged into the intake passage, an air-fuel ratio sensor located in an exhaust passage of the engine for detecting an air-fuel ratio of the engine, fuel injection control means for controlling a fuel injection amount according to an output signal of the air-fuel ratio sensor so that the air-fuel ratio of the engine approaches a target air-fuel ratio, said evaporative control method comprising the steps of:

detecting the speed of the engine;

judging whether the detected speed of the engine falls within a synchronism domain in which a duty cycle of the purging control valve is substantially synchronous with the detected engine speed;

when it is judged that the speed of the engine falls within the synchronism domain, limiting a duty cycle based on the speed of the engine to a value within a set range, wherein the duty cycle indicates a ratio of an open time of the purging control valve to the drive cycle thereof;

when it is judged that the speed of the engine falls within the synchronism domain, calculating a purge ratio relative to the limited duty cycle limited; and opening and closing the purging control valve at the duty cycle to provide the purge ratio calculated in the previous step.

5. An evaporative method according to claim 4, further comprising the steps of:

measuring an elapsed time since the onset of purging control; and determining, on the basis of the measured elapsed time, whether the duty cycle is limited to a value within the set range.

6. A method for controlling an evaporative control system in an internal combustion engine, wherein the evaporative control system comprises a canister for temporarily holding fuel vapor from a fuel tank, a purge passage for communicating the canister with an intake passage of the engine, a purging control valve located in the purge passage for controlling an amount gas purged into the intake passage, an air-fuel ratio sensor located in an exhaust passage of the engine for detecting an air-fuel ratio of the engine, fuel injection control means for controlling a fuel injection amount according to an output signal of the air-fuel ratio sensor so that the air-fuel ratio of the engine approaches a target air-fuel ratio, said evaporative control method comprising the steps of:

detecting the speed of the engine;

judging whether the detected speed of the engine falls within a synchronism domain in which a drive cycle of the purging control valve is substantially synchronous with the detected engine speed;

calculating, based on a deviation of the air-fuel ratio during purging, a concentration of the purge gas supplied to a cylinder of the engine;

correcting a fuel injection amount according to the calculated purged gas concentration;

calculating, based on the engine speed, a ratio of a maximum magnitude of purging to an amount of fuel supplied to the engine;

calculating a limit purge ratio on the basis of the purged gas concentration and the maximum magnitude of purging;

when it is judged that the speed of the engine falls within the synchronism domain, limiting a target purge ratio to a value at least as small as the limit purge ratio;

when it is judged that the speed of the engine falls within the synchronism domain, calculating a purge ratio according to the target purge ratio; and opening and closing the purging control valve at the duty cycle to provide the purge ratio calculated in the previous step, wherein the duty cycle indicates a ratio of an open time of the purging control valve to the drive cycle thereof.

* * * * *

UNITED STATES PATENT AND TRADEMARK OFFICE

CERTIFICATE OF CORRECTION

PATENT NO. : 5,778,867
DATED : July 14, 1998
INVENTOR(S) : Akinori OSANAI

It is certified that error appears in the above-identified patent and that said Letters Patent is hereby corrected as shown below:

Column 1, line 34, change "becomes" to --become--.

Column 3, line 4, delete "to" after "equal".

Column 6, line 53, insert a comma after "that is".

Column 12, line 51, change "85" to --15--.

Column 18, line 37, after "amount" insert --of--.

Column 19, line 19, after "amount" insert --of--.

Column 19, line 40, delete "limited" after "cycle".

Signed and Sealed this

Thirtieth Day of January, 2001

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,778,867

DATED : July 14, 1998

INVENTOR(S) : Akinori Osanai

It is certified that error appears in the above-identified patent and that said Letters Patent is hereby corrected as shown below:

Column 17, line 62, after "amount" insert --of--.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*